US007988272B2

(12) United States Patent
Takatsuka

(10) Patent No.: US 7,988,272 B2
(45) Date of Patent: Aug. 2, 2011

(54) IMAGE RECORDING APPARATUS AND INKJET APPARATUS FOR DOUBLE-SIDE RECORDING

(75) Inventor: Tsutomu Takatsuka, Kanagawa (JP)

(73) Assignee: Fujifilm Corporation, Tokyo (JP)

( * ) Notice: Subject to any disclaimer, the term of this patent is extended or adjusted under 35 U.S.C. 154(b) by 0 days.

(21) Appl. No.: 12/560,195

(22) Filed: Sep. 15, 2009

(65) Prior Publication Data

US 2010/0002030 A1 Jan. 7, 2010

Related U.S. Application Data

(62) Division of application No. 11/364,198, filed on Mar. 1, 2006, now Pat. No. 7,661,810.

(30) Foreign Application Priority Data

Mar. 2, 2005 (JP) ..... 2005-057926
Mar. 2, 2005 (JP) ..... 2005-057927
Mar. 2, 2005 (JP) ..... 2005-057928

(51) Int. Cl.
*B41J 2/175* (2006.01)
*B41J 2/01* (2006.01)
*B41J 2/17* (2006.01)
*B41J 2/195* (2006.01)
*B41J 29/38* (2006.01)

(52) U.S. Cl. ..... 347/85; 347/104; 347/84; 347/7; 347/9

(58) Field of Classification Search ..... 347/104, 347/101, 5, 9, 102, 8, 20, 37, 40, 16, 84, 347/85, 86, 87, 89, 90, 91, 29, 30, 31, 32, 347/33, 34, 35, 36, 42, 7
See application file for complete search history.

(56) References Cited

U.S. PATENT DOCUMENTS 4,282,536 A * 8/1981 Paschen et al. ..... 346/140.1
(Continued)

FOREIGN PATENT DOCUMENTS

JP 2-194965 A 8/1990
(Continued)

OTHER PUBLICATIONS

Japanese Office Action issued Jun. 14, 2010, in corresponding Japanese Application No. 2005-057927.

*Primary Examiner* — Stephen D Meier
*Assistant Examiner* — Leonard S Liang
(74) *Attorney, Agent, or Firm* — Birch, Stewart, Kolasch & Birch, LLP

(57) ABSTRACT

The inkjet apparatus for double-side recording, comprises: liquid ejection heads which are disposed on either side of a recording medium and face each other across the recording medium, the liquid ejection heads ejecting liquid onto recording surfaces of the recording medium; conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; and end supporting devices which support an upper end and a lower end of the recording medium, as the conveyance devices convey the recording medium in a horizontal direction while holding the recording medium in such a manner that the normal of each of the recording surfaces is substantially horizontal.

8 Claims, 18 Drawing Sheets

U.S. PATENT DOCUMENTS

| | | | | | |
|---|---|---|---|---|---|
| 4,340,893 | A | * | 7/1982 | Ort | 347/102 |
| 4,475,128 | A | | 10/1984 | Koumura | |
| 4,513,297 | A | * | 4/1985 | Okamura | 347/85 |
| 4,677,448 | A | * | 6/1987 | Mizusawa et al. | 347/85 |
| 4,839,741 | A | | 6/1989 | Wilson | |
| 5,376,957 | A | | 12/1994 | Gandy et al. | |
| 5,670,995 | A | | 9/1997 | Kupcho et al. | |
| 5,689,293 | A | | 11/1997 | Hirano | |
| 5,751,308 | A | * | 5/1998 | Gandy et al. | 347/33 |
| 5,757,397 | A | | 5/1998 | Hirano et al. | |
| 5,801,721 | A | * | 9/1998 | Gandy et al. | 347/3 |
| 5,847,736 | A | * | 12/1998 | Kanbayashi et al. | 347/89 |
| 5,896,143 | A | * | 4/1999 | Matsui et al. | 347/24 |
| 6,019,452 | A | | 2/2000 | Hirano et al. | |
| 6,049,680 | A | | 4/2000 | Goris et al. | |
| 6,139,136 | A | * | 10/2000 | Mackay et al. | 347/85 |
| 6,139,206 | A | | 10/2000 | Ahn | |
| 6,196,668 | B1 | * | 3/2001 | Bode | 347/85 |
| 7,070,255 | B2 | * | 7/2006 | Nakajima | 347/29 |
| 7,070,257 | B2 | * | 7/2006 | Silverbrook | 347/42 |
| 7,097,290 | B2 | * | 8/2006 | Yoshida | 347/85 |
| 7,104,637 | B1 | * | 9/2006 | Van Steenkiste | 347/85 |
| 7,185,980 | B2 | * | 3/2007 | Kumamoto et al. | 347/102 |
| 7,234,803 | B2 | * | 6/2007 | Amma et al. | 347/86 |
| 7,357,481 | B2 | * | 4/2008 | Baker | 347/40 |
| 7,661,810 | B2 | * | 2/2010 | Takatsuka | 347/104 |
| 2002/0005872 | A1 | | 1/2002 | Goto et al. | |
| 2002/0024544 | A1 | | 2/2002 | Codos | |
| 2003/0043246 | A1 | | 3/2003 | Codos | |
| 2003/0160846 | A1 | * | 8/2003 | Yoshida et al. | 347/85 |
| 2003/0185607 | A1 | | 10/2003 | Goldman et al. | |
| 2004/0079248 | A1 | | 4/2004 | Mayer et al. | |
| 2004/0100512 | A1 | | 5/2004 | Codos | |
| 2005/0024459 | A1 | | 2/2005 | Codos | |
| 2008/0049088 | A1 | | 2/2008 | Codos | |
| 2009/0225145 | A1 | | 9/2009 | Codos | |

FOREIGN PATENT DOCUMENTS

| | | | |
|---|---|---|---|
| JP | 5-319550 | A | 12/1993 |
| JP | 3000046 | U | 7/1994 |
| JP | 6-312735 | A | 11/1994 |
| JP | 7-314849 | A | 12/1995 |
| JP | 10-305594 | A | 11/1998 |
| JP | 11-288097 | A | 10/1999 |
| JP | 2001-301239 | A | 10/2001 |
| JP | 2001-310458 | A | 11/2001 |
| JP | 3081608 | U | 11/2001 |
| JP | 2003-182094 | A | 7/2003 |
| JP | 2004-508220 | A | 3/2004 |
| JP | 2004-155033 | A | 6/2004 |
| JP | 2004-181871 | A | 7/2004 |
| JP | 2004-216680 | A | 8/2004 |
| WO | WO 02/18148 | A1 | 3/2002 |

* cited by examiner

IMAGE RECORDING APPARATUS AND INKJET APPARATUS FOR DOUBLE-SIDE RECORDING

This application is a Divisional of application Ser. No. 11/364,198, filed on Mar. 1, 2006 now U.S. Pat. No. 7,661,810, the entire contents of which are hereby incorporated by reference and for which priority is claimed under 35 U.S.C. §120. This application claims priority to Application Nos. 2005-057926, 2005-057927 and 2005-057928, filed in Japan on Mar. 2, 2005, under 35 U.S.C. §119, the entire contents of which are hereby incorporated by reference.

BACKGROUND OF THE INVENTION

1. Field of the Invention

The present invention relates to an image recording apparatus and an inkjet apparatus for double-side recording, and more particularly, to an image recording apparatus which seeks to stabilize ejection from an ejection head that ejects ink in a horizontal direction, and to an inkjet apparatus for double-side recording which can perform double-side recording by using this image recording apparatus, onto a rigid plate-shaped recording medium which is hard, heavy, and unbendable.

2. Description of the Related Art

In general, an inkjet recording apparatus (inkjet printer) that includes an inkjet head having an arrangement of a plurality of nozzles for ejecting ink, is known. Such an inkjet recording apparatus forms images on a recording medium by ejecting ink from the nozzles while causing the inkjet head and the recording medium to move relatively to each other.

Many inkjet recording apparatuses of this kind record images only on one side of a recording medium. However, inkjet recording apparatuses capable of double-side recording are demanded because of saving recording media or other reasons.

In view of such circumstances, various inkjet recording apparatuses for double-side recording have been proposed, which are capable of recording onto both sides of a recording medium that is a flexible medium, such as paper, resin sheet, cloth, or the like.

For example, Japanese Patent Application Publication No. 2003-182094 discloses an apparatus in which one or a plurality of recording heads are disposed on each side of a recording medium, the recording heads facing the sides of the recording medium. The recording heads can substantially simultaneously print on both sides of the recording medium, and images can be substantially simultaneously printed onto both recording surfaces of the recording medium, in a sequence of operations. In this way, the recording time can be shortened and the apparatus can be reduced in size.

Furthermore, Japanese Patent Application Publication No. 2004-181871 discloses an apparatus that has a recording medium reversal mechanism for recording on both sides of a medium. In this apparatus, after recording on one side of the medium, the recording medium is reversed with respect to the recording surface by means of the reversal mechanism, the medium is then conveyed while the recording medium is kept to faces the ejection openings of the recording head, and then recording is performed on the other surface of the recording medium. In this way, double-side recording and high-speed recording can be achieved.

Moreover, for example, Japanese Patent Application Publication No. 2004-216680 discloses an apparatus in which two rotating drums provided with recording heads are disposed in series on a conveyance path of a recording medium.

In this apparatus, firstly, the recording medium is wound up onto the first rotating drum and recording is performed on one surface of the recording medium, whereupon the recording medium is wound up onto the second rotating drum and recording is performed on the other surface of the recording medium, so that images are recorded onto both sides of the recording medium. In this way, double-side recording can be achieved at high-speed by means of the compact apparatus.

Furthermore, for example, Japanese Patent Application Publication No. 2001-310458 discloses an apparatus capable of borderless recording and simultaneous recording onto both surfaces of a recording sheet. As one example of the apparatus, an apparatus is known in which an ink acceptance device and a wiping device are disposed on each side of the recording sheet and each ink acceptance device is disposed across a recording sheet from the wiping device. In this apparatus, the recording device, the ink receiving apparatus, and the wiping apparatus can reciprocate in a perpendicular direction with respect to the conveyance direction.

In an inkjet apparatus for double-side recording, in order to achieve both high-speed recording and double-side recording, it is important to shorten the recording time by recording on both sides of a recording medium substantially simultaneously, and to shorten the conveyance time by shortening the conveyance path for the recording medium.

Furthermore, in these days, there are requirements for double-side recording onto various types of recording media, and in particular, there is a requirement to perform double-side recording onto rigid plate-shaped recording media that are thick, hard, heavy, and unbendable, such as glass plates, iron plates, cardboard sheets, wooden sheets, and the like. In addition, desirably, recording can be adapted to a plurality of thicknesses.

However, the double-side recording technology described above has a possibility that it cannot meet requirements of these kinds.

For example, in the technology described in Japanese Patent Application Publication No. 2003-182094, images can be simultaneously recorded onto both surfaces of a recording medium. However, since the recording medium is conveyed in a downward perpendicular direction with respect to the recording head, it is difficult to convey the recording medium stably if the recording medium is heavy. Furthermore, the distances between the recording heads and the recording surface are almost uniform, and the rollers of the conveyance device have no mechanism for adapting to change in the thickness of the recording medium. Hence, it is difficult to adapt to a plurality of types of recording media having different thicknesses.

Moreover, in the apparatus described in Japanese Patent Application Publication No. 2004-181871, since it is difficult to bend rigid plate-shaped recording media as described above, such a medium cannot be reversed with the reversal mechanism (switch back mechanism). Hence, it is difficult for the apparatus to perform the double-side recording onto the rigid plate-shaped bodies as described above. Furthermore, it is difficult to adapt to a plurality of types of recording media having different thicknesses.

Moreover, in the apparatus described in Japanese Patent Application Publication No. 2004-216680, similarly, since it is difficult to bend rigid plate-shaped recording media as described above, it is difficult to perform the double-side printing. Furthermore, in this case, it is difficult to adapt it to a plurality of types of recording media having different thicknesses.

Moreover, in the apparatus described in Japanese Patent Application Publication No. 2001-310458, if ink is ejected onto the end sections of a recording medium or sections where no recording medium is present when the recording medium is thick, then the liquid droplets ejected from the head of which the ejection direction is the vertically upward direction, falls back onto and adheres to the nozzle surface, giving rise to ejection defects. Furthermore, even if an ink receiving apparatus is used for an apparatus that ejects ink horizontally, then it is difficult to gather the ink accurately in the ink receiving apparatus because the ink droplets drop under the effects of their own weight. As a result of that, soiling of the interior of the apparatus may occur, and consequently the quality of the recorded image may decline.

Moreover, if double-side recording is carried out while the recording medium is held vertically and conveyed in a horizontal direction, then the negative pressure balance at the ejection openings can be disrupted due to the arrangement of the print head. Hence, leakage of liquid from the ejection openings, loss of ejection stability, or the like may occur.

SUMMARY OF THE INVENTION

The present invention has been contrived in view of the aforementioned circumstances, an object thereof being to provide an image recording apparatus, and an inkjet apparatus for double-side recording, which enable double-side recording and is adapted to a plurality of different thicknesses, even in the case where a rigid plate-shaped recording medium that is heavy, hard and/or unbendable is used as a medium. Another object of the present invention is to provide an image recording apparatus, and an inkjet apparatus for double-side recording, which can reliably gather liquid ejected during purging and eliminate soiling of the periphery of the liquid ejection head. Another object of the present invention is to provide an image recording apparatus, and an inkjet apparatus for double-side recording, which can maintain the negative pressure balance at the ejection openings, prevent leakage of liquid, and keep the liquid-ejection stable.

In order to attain the aforementioned object, the present invention is directed to an inkjet apparatus for double-side recording, comprising: liquid ejection heads which are disposed on either side of a recording medium and face each other across the recording medium, the liquid ejection heads ejecting liquid onto recording surfaces of the recording medium; conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; and end supporting devices which support an upper end and a lower end of the recording medium, as the conveyance devices convey the recording medium in a horizontal direction while holding the recording medium in such a manner that the normal of each of the recording surfaces is substantially horizontal.

According to this aspect of the present invention, the recording medium is held substantially vertically and is conveyed horizontally while the upper and lower ends of the recording medium are supported, and double-side recording can be performed substantially simultaneously from print heads disposed on either side of the conveyed recording medium. Accordingly, it is possible to carry out double-side recording satisfactorily onto a rigid, plate-shaped recording medium, which is heavy and/or unbendable.

Preferably, the inkjet apparatus further comprises ultraviolet light irradiation devices which are disposed on either side of the recording medium, wherein: the liquid is an ultraviolet-curable ink; and the ultraviolet light irradiation devices irradiate ultraviolet light onto the recording surfaces after the liquid ejection heads eject liquid onto the recording surfaces.

According to this aspect, the liquid deposited onto the recording surfaces of the recording medium held in a vertical position is cured and fixed immediately after landing on the medium. Accordingly, flowing of the deposited liquid is prevented and good double-side recording can be performed.

Preferably, at least one of distance between the liquid ejection heads facing each other across the recording medium, distance between the ultraviolet light irradiation devices facing each other across the recording medium, distance between the conveyance devices facing each other across the recording medium, and distance between the end supporting devices facing each other across the recording medium, is variable.

Preferably, the inkjet apparatus further comprises a thickness measurement device which measures thickness of the recording medium, wherein the at least one of the distance between the liquid ejection heads, the distance between the ultraviolet light irradiation devices, the distance between the conveyance devices, and the distance between the end supporting devices, is changed in accordance with the thickness of the recording medium.

According to these aspects, it is possible to adjust the pressure with which the recording medium is held, flight distance of the liquid, or the like, in accordance with the thickness of the recording medium. Accordingly, good double-side recording can be performed.

Preferably, a plurality of the end supporting devices for fixed different sizes corresponding to various thicknesses of an end of the recording medium, are provided; and the end supporting devices are exchanged in accordance with the thickness of the recording medium.

According to this aspect, it is possible to perform double-side recording in an appropriate fashion, onto a recording medium having a small thickness.

Preferably, the inkjet apparatus further comprises: a recording medium supply device which rotates the recording medium, which is chosen from a plurality of recording media which are stacked in a horizontal position, in such a manner that the recording medium is oriented vertically, and sends the recording medium to the conveyance devices; and an output device which receives the recording medium which is held in a vertical position and conveyed after recording, rotates the recording medium in such a manner that the recording medium is oriented horizontally, and stacks the recording medium.

According to this aspect, the supply and output of the recording medium is facilitated, and the double-side recording operation is made more efficient.

In order to attain the aforementioned object, the present invention is also directed to an inkjet apparatus for double-side recording, comprising: liquid ejection heads which are disposed on either side of a recording medium and face each other across the recording medium, the liquid ejection heads horizontally ejecting liquid onto recording surfaces of the recording medium; and liquid recovery devices which are provided on surfaces of the liquid ejection heads facing each other, the liquid recovery device provided on the surface of one of the liquid ejection heads gathering the liquid ejected from an ejection surface of the other of the liquid ejection heads, wherein: at least one ejection opening, which is formed in each of the ejection surfaces, is provided on an upper side of each of the ejection surfaces; and at least one opening section for gathering the liquid in the liquid recovery devices is provided on a side lower than a position where the ejection opening is formed on each of the ejection surfaces.

According to this aspect of the present invention, it is possible to reliably collect liquid ejected horizontally from the ejection opening of the ejection surfaces of the liquid ejection heads, even if the liquid falls downward in a parabolic-like curve, due to its own weight. Consequently, soiling of the periphery of the nozzle surface and the interior of the apparatus is prevented, adherence of liquid to the recording medium is prevented, and the quality of the recorded image can be maintained.

The present invention is also directed to an inkjet apparatus for double-side recording, comprising: liquid ejection heads which are disposed on either side of a recording medium and face each other across the recording medium, the liquid ejection heads horizontally ejecting liquid onto recording surfaces of the recording medium; liquid recovery devices which are provided on surfaces of the liquid ejection heads facing each other, the liquid recovery device provided on the surface of one of the liquid ejection heads gathering the liquid ejected from an ejection surface of the other of the liquid ejection heads; and a movement device which moves the liquid recovery devices up and down.

According to this aspect of the present invention, it is possible to form ejection openings over the whole regions of the ejection surfaces, there is no need to extend the opening section of the liquid recovery devices in a downward direction, and furthermore, the liquid can be reliably gathered even if the distances between the ejection opening and the liquid recovery devices are large.

The present invention is also directed to an inkjet apparatus for double-side recording, comprising: liquid ejection heads which are disposed on either side of a recording medium and face each other across the recording medium, the liquid ejection heads ejecting liquid onto recording surfaces of the recording medium; conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; end supporting devices which support an upper end and a lower end of the recording medium, as the conveyance devices convey the recording medium in a horizontal direction while holding the recording medium in such a manner that the normal of each of the recording surfaces is substantially horizontal; and liquid recovery devices which are provided on surfaces of the liquid ejection heads facing each other, the liquid recovery device provided on the surface of one of the liquid ejection heads gathering the liquid ejected from an ejection surface of the other of the liquid ejection heads, wherein: at least one ejection opening, which is formed in each of the ejection surfaces, is provided on an upper side of each of the ejection surfaces; and at least one opening section for gathering the liquid in the liquid recovery devices is provided on a side lower than a position where the ejection opening is formed on each of the ejection surfaces.

According to this aspect of the present invention, double-side recording can be performed onto a heavy and thick recording medium, and furthermore, the liquid ejected from the ejection opening on the ejection surfaces of the liquid ejection heads can be reliably gathered. Thus, soiling of the periphery of the nozzle surfaces and the interior of the apparatus is prevented, and the quality of the recorded image can be maintained.

The present invention is also directed to an inkjet apparatus for double-side recording, comprising: liquid ejection heads which are disposed on either side of a recording medium and face each other across the recording medium, the liquid ejection heads ejecting liquid onto recording surfaces of the recording medium; conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; end supporting devices which support an upper end and a lower end of the recording medium, as the conveyance devices convey the recording medium in a horizontal direction while holding the recording medium in such a manner that the normal of each of the recording surfaces is substantially horizontal; liquid recovery devices which are provided on surfaces of the liquid ejection heads facing each other, the liquid recovery device provided on the surface of one of the liquid ejection heads gathering the liquid ejected from an ejection surface of the other of the liquid ejection heads; and a movement device which moves the liquid recovery devices up and down.

According to this aspect of the present invention, double-side recording can be performed onto a heavy and thick recording medium. Moreover, it is possible to form ejection openings over the whole area of the ejection surfaces. Furthermore, the liquid ejected from the ejection openings on the ejection surfaces of the liquid ejection heads can be reliably gathered, without extending the opening section downwards in the liquid recovery devices.

Preferably, the inkjet apparatus further comprises ultraviolet light irradiation devices which are disposed on either side of the recording medium, wherein: the liquid is an ultraviolet-curable ink; and the ultraviolet light irradiation devices irradiate ultraviolet light onto the recording surfaces after the liquid ejection heads eject liquid onto the recording surfaces.

According to this aspect, the liquid deposited onto the recording surfaces of the recording medium held vertically, are cured and fixed immediately after landing on the medium. Accordingly, flowing of the deposited liquid is prevented and good double-side recording can be performed.

Preferably, at least one of distance between the liquid ejection heads facing each other across the recording medium, distance between the ultraviolet light irradiation devices facing each other across the recording medium, distance between the conveyance devices facing each other across the recording medium, and distance between the end supporting devices facing each other across the recording medium, is variable.

Preferably, the inkjet apparatus further comprises a thickness measurement device which measures thickness of the recording medium, wherein the at least one of the distance between the liquid ejection heads, the distance between the ultraviolet light irradiation devices, the distance between the conveyance devices, and the distance between the end supporting devices, is changed in accordance with the thickness of the recording medium.

According to these aspects, it is possible to adjust the pressure with which the recording medium is held, the flight distance of the liquid, or the like, in accordance with the thickness of the recording medium. Hence, good double-side recording can be performed.

Preferably, a plurality of the end supporting devices for fixed different sizes corresponding to various thicknesses of an end of the recording medium, are provided; and the end supporting devices are exchanged in accordance with the thickness of the recording medium.

According to this aspect, it is possible to perform double-side recording in an appropriate fashion, onto a recording medium having a small thickness.

Preferably, the inkjet apparatus further comprises: a recording medium supply device which rotates the recording medium, which is chosen from a plurality of recording media which are stacked in a horizontal position, in such a manner that the recording medium is oriented vertically, and sends the recording medium to the conveyance devices; and an output device which receives the recording medium which is held in a vertical position and conveyed after recording, rotates the recording medium in such a manner that the recording medium is oriented horizontally, and stacks the recording medium.

According to this aspect, the supply and output of the recording medium are facilitated, and the double-side recording operation is made more efficient.

In order to attain the aforementioned object, the present invention is also directed to an image recording apparatus, comprising: a liquid ejection head which is disposed in such a manner that a lengthwise direction thereof is vertically oriented, the liquid ejection head ejecting liquid in a horizontal direction; common liquid chambers which are divided and extend in a vertical direction, the common liquid chambers supplying the liquid to ejection openings of the liquid ejection head; and sub-tanks which are connected to the common liquid chambers and supply the liquid to the common liquid chambers, wherein negative pressures in the common liquid chambers are adjusted by controlling a difference between top heights of the liquids in the sub-tanks.

According to this aspect of the present invention, it is possible to prevent leaking of liquid from the ejection opening of the liquid ejection heads, and ejection can be stabilized.

Preferably, the image recording apparatus further comprises a main tank which supplies the liquid the sub-tank where the top height of the liquid is controlled so as to be the highest of those in the sub-tanks, through a bottom of the sub-tank, wherein the negative pressures in the common liquid chambers are adjusted by moving the liquid between the sub-tanks in accordance with the difference between the top heights of the liquids in the sub-tanks, in such a manner that each of the top heights of the liquids in the sub-tanks corresponds to a vertical position of the corresponding common liquid chamber.

According to this aspect, it is possible to reduce the number of pumps required to control the liquid head height in the sub-tanks, and hence the composition of the apparatus can be simplified.

The present invention is also directed to an inkjet apparatus for double-side recording, comprising: liquid ejection heads which are disposed on either side of a recording medium and face each other across the recording medium in such a manner that a lengthwise direction of the liquid ejection heads is vertically oriented, the liquid ejection heads ejecting liquid in a horizontal direction onto recording surfaces of the recording medium; common liquid chambers which are divided and extend in a vertical direction, the common liquid chambers supplying the liquid to ejection openings of the liquid ejection head; sub-tanks which are connected to the common liquid chambers and supply the liquid to the common liquid chambers, negative pressures in the common liquid chambers being adjusted by controlling a difference between top heights of the liquids in the sub-tanks; conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; and end supporting devices which support an upper end and a lower end of the recording medium, as the conveyance devices convey the recording medium in a horizontal direction while holding the recording medium in such a manner that the normal of each of the recording surfaces is substantially horizontal.

According to this aspect, double-side recording is possible, even in the case of a rigid plate-shaped recording medium that is hard, heavy, and unbendable. Furthermore, the negative pressure balance at the ejection opening is preserved, leaking of liquid is prevented, and therefore, stable ejection can be maintained.

Preferably, the inkjet apparatus further comprises ultraviolet light irradiation devices which are disposed on either side of the recording medium, wherein: the liquid is an ultraviolet-curable ink; and the ultraviolet light irradiation devices irradiate ultraviolet light onto the recording surfaces after the liquid ejection heads eject liquid onto the recording surfaces.

According to this aspect, the liquid deposited onto the recording surfaces of the recording medium held vertically are cured and fixed immediately after landing on the medium. Accordingly, flowing of the deposited liquid is prevented and good double-side recording can be performed.

Preferably, at least one of distance between the liquid ejection heads facing each other across the recording medium, distance between the ultraviolet light irradiation devices facing each other across the recording medium, distance between the conveyance devices facing each other across the recording medium, and distance between the end supporting devices facing each other across the recording medium, is variable.

Preferably, the inkjet apparatus further comprises a thickness measurement device which measures thickness of the recording medium, wherein the at least one of the distance between the liquid ejection heads, the distance between the ultraviolet light irradiation devices, the distance between the conveyance devices, and the distance between the end supporting devices, is changed in accordance with the thickness of the recording medium.

According to these aspects, it is possible to adjust the pressure with which the recording medium is held, the flight distance of the liquid, or the like, in accordance with the thickness of the recording medium. Hence, good double-side recording can be performed.

Preferably, a plurality of the end supporting devices for fixed different sizes corresponding to various thicknesses of an end of the recording medium, are provided; and the end supporting devices are exchanged in accordance with the thickness of the recording medium.

According to this aspect, it is possible to perform double-side recording in an appropriate fashion, onto a recording medium having a small thickness.

Preferably, the inkjet apparatus further comprises: a recording medium supply device which rotates the recording medium, which is chosen from a plurality of recording media which are stacked in a horizontal position, in such a manner that the recording medium is oriented vertically, and sends the recording medium to the conveyance devices; and an output device which receives the recording medium which is held in a vertical position and conveyed after recording, rotates the recording medium in such a manner that the recording medium is oriented horizontally, and stacks the recording medium.

According to this aspect, the supply and output of the recording medium are facilitated, and the double-side recording operation is made more efficient.

According to the inkjet apparatus for double-side recording based on the present invention, the recording medium is substantially vertically held and is horizontally conveyed while the upper and lower ends of the recording medium are supported, double-side recording being performed substantially simultaneously by print heads disposed on either side of the conveyed recording medium. Accordingly, it is possible to carry out double-side recording satisfactorily onto a rigid, plate-shaped recording medium, which is heavy and unbendable.

Furthermore, if liquid recovery devices are provided, then it is possible to reliably gather liquid ejected from the ejection opening of the ejection surfaces of the liquid ejection head. Thereby, soiling of the periphery of the nozzle surface and the interior of the apparatus is prevented, and the quality of the recorded image can be maintained.

Moreover, if the negative pressures of the common liquid chambers are adjusted according to the difference between the liquid head heights in sub-tanks which are connected to the common liquid chambers, then the negative pressure balance at the ejection opening can be preserved, leaking of liquid is prevented, and hence stable ejection can be maintained.

BRIEF DESCRIPTION OF THE DRAWINGS

The nature of this invention, as well as other objects and benefit thereof, will be explained in the following with reference to the accompanying drawings, wherein.

DETAILED DESCRIPTION OF THE PREFERRED EMBODIMENTS

An image forming apparatus and an image forming method according to embodiments of the present invention are described below in detail, with reference to the drawings. In the inkjet apparatus for double-side recording according to the present embodiment, examples of the recording media include a rigid plate-shaped body that is hard and unbendable or a medium that must not be bent, such as a glass plate, iron plate, cardboard sheet, wooden sheet, resin sheet, or the like. The thickness of most examples of the recording media can be 1 mm through 30 mm. Furthermore, the examples of the recording media include a medium having a rigid plate-shaped member as a base material, such as a medium formed by appending paper to a cardboard sheet. Moreover, examples of the ink used include an ultraviolet (UV) light curable ink. For example, a UV light source may be disposed after the head in terms of the conveyance direction of the recording medium, in such a manner that ultraviolet light is irradiated onto the medium immediately after ink ejection, thereby fixing the ink onto the recording medium.

Firstly, a first embodiment according to the present invention is described below. In the first embodiment, long line type heads are disposed on either side of a recording medium that is conveyed while being held vertically, the lengthwise direction of each head being held in a vertical direction and being substantially perpendicular to the conveyance direction of the recording medium. Double-side recording is performed by this apparatus.

Figure 1:
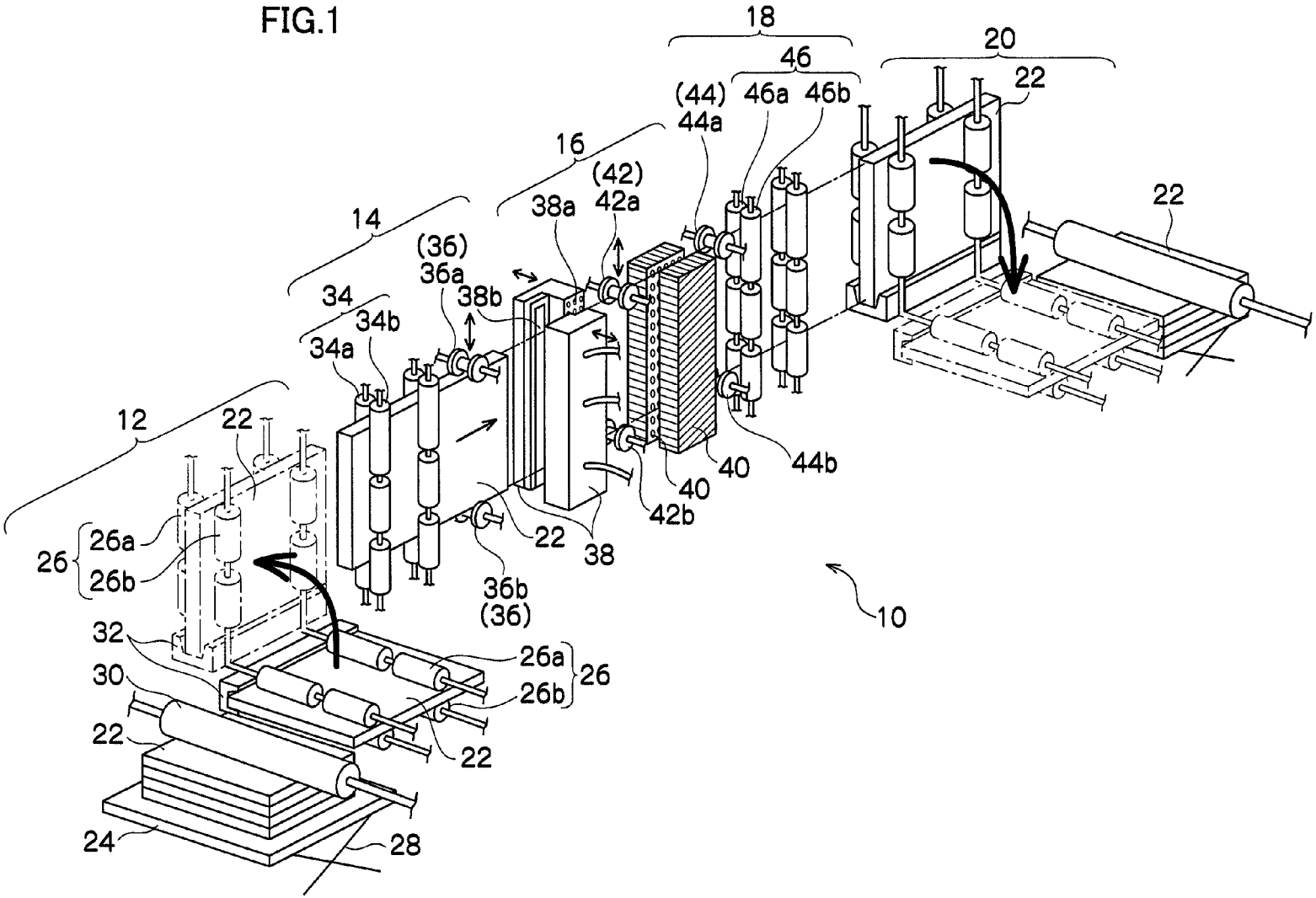
FIG. 1 is an oblique diagram showing the general composition of an inkjet apparatus for double-side recording using the image recording apparatus relating to a first embodiment according to the present invention.
Figure 2:
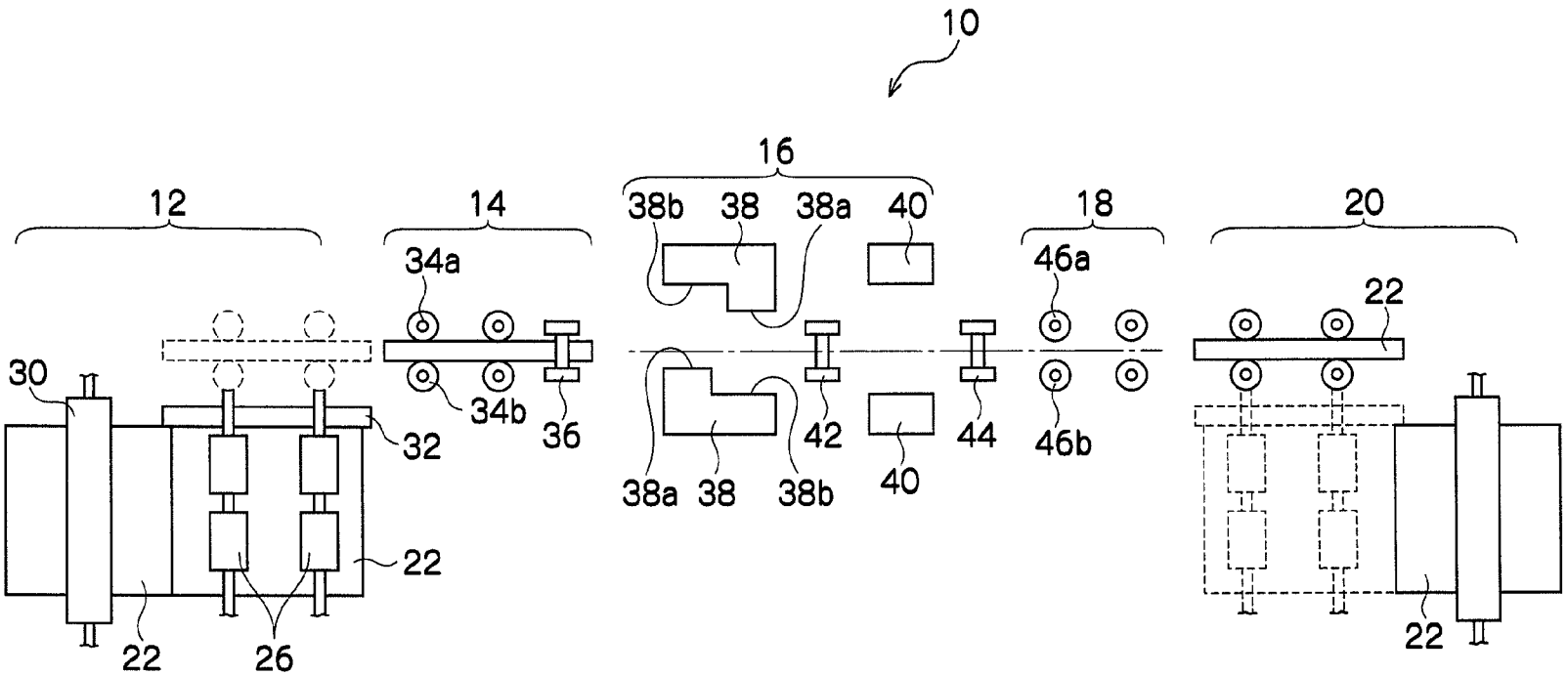
FIG. 2 is an upper side diagram showing a case where the inkjet apparatus for double-side recording shown in FIG. 1 is viewed from above.
Figure 3:
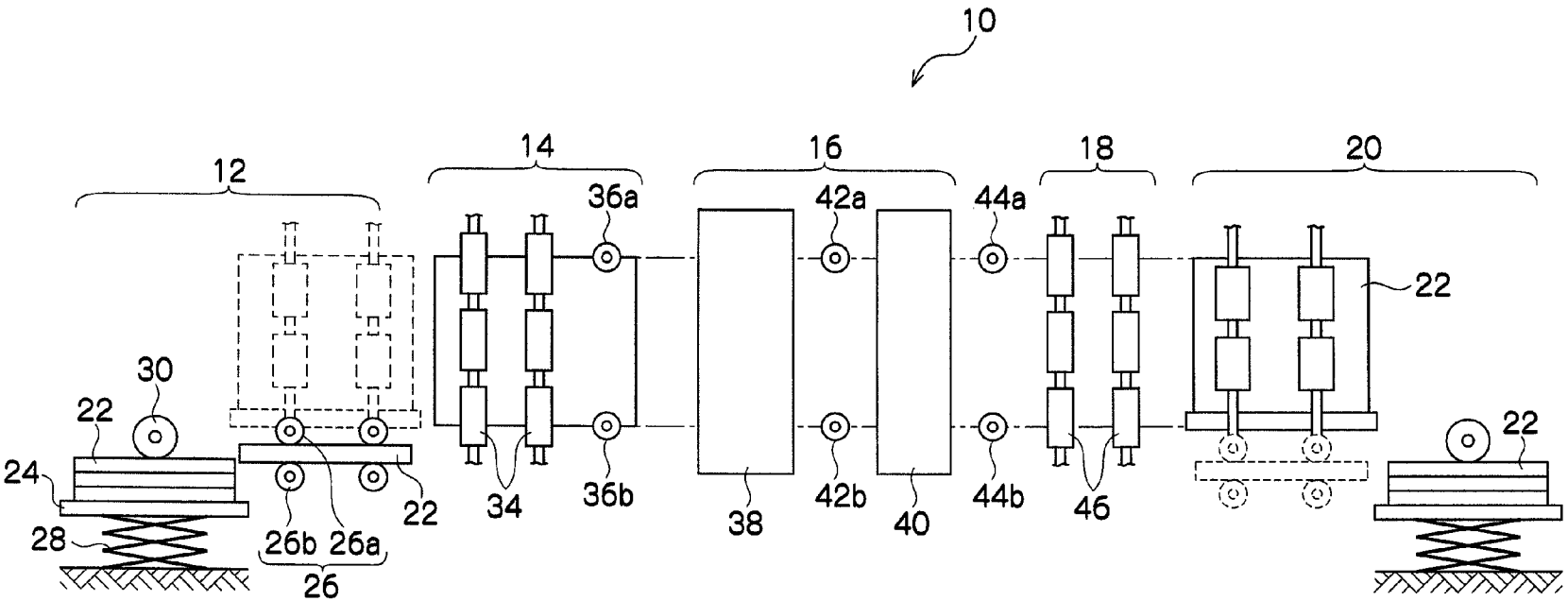
FIG. 3 is a side diagram showing a case where the inkjet apparatus for double-side recording shown in FIG. 1 is viewed from the right-hand side.

FIG. 1 is an oblique diagram showing the general composition of the inkjet apparatus for double-side recording using the image recording apparatus according to the first embodiment of the present invention. FIG. 2 is an upper side view showing a situation where the inkjet apparatus for double-side recording shown in FIG. 1 is viewed from above. FIG. 3 is a side view showing a situation where the inkjet apparatus for double-side recording shown in FIG. 1 is viewed from the right-hand (front) side.

As shown in FIGS. 1, 2, and 3, the inkjet apparatus 10 for double-side recording according to the present embodiment includes a supply unit 12, a front conveyance unit 14, a recording unit 16, a rear conveyance unit 18, and an output unit 20.

The supply unit 12 supplies a rigid plate-shaped recording medium 22 that is thick, heavy, hard, and/or unbendable, to the recording unit 16. The supply unit 12 includes a loading platform 24 on which a plurality of recording media 22 are loaded in horizontal positions, and pairs of gripping rollers 26 (26*a* and 26*b*) for lifting up each of the loaded recording media 22 to a vertical position, and transferring it to the front conveyance unit 14.

The loading platform 24 is provided in order that the plate-shaped recording media 22 in horizontal positions are stacked thereon. As shown in FIG. 1 or FIG. 3, a spring 28 is provided under the loading platform 24. The spring 28 presses the loading platform 24 upward from below, thereby causing the stacked recording media 22 to press against a roller 30 disposed above the loading platform 24.

This roller 30 feeds the stacked recording media 22 one by one from above, toward the gripping rollers 26 (26*a* and 26*b*). In the embodiment shown in FIG. 1, two pairs of gripping rollers 26 (26*a* and 26*b*) are provided, and the recording medium 22 is held between the rollers by being pressed from both sides. Although described in more detail below, the gripping rollers 26 have a mechanism that adjusts the distance between the opposing rollers 26*a* and 26*b* in accordance with the thickness of the recording medium 22.

While the gripping rollers 26 continue to hold both sides of the recording medium 22, both the rollers and the medium are raised upward to a vertical position by being rotated by a rotating mechanism (described hereinafter) as shown by the arrow in FIG. 1, until reaching the position indicated by the broken lines. In this case, as described in detail below, a lower side guide 32 which supports the recording medium 22 from below is provided in such a manner that the vertically held recording medium 22 does not slip downward due to its own weight.

When the gripping rollers 26 are raised upward vertically, the recording medium 22 held vertically is sent to the front conveyance unit 14. The front conveyance unit 14 includes conveyance rollers 34 (34*a* and 34*b*) which hold the recording medium 22 vertically by gripping same from both sides, and end face supporting rollers 36 (36*a* and 36*b*) which support the upper and lower ends of the recording medium 22 held vertically. The front conveyance unit 14 conveys the recording medium 22 to the recording unit 16 while holding the recording medium 22 in a vertical position. Similarly to the gripping rollers 26, the distance between the conveyance rollers 34 can also be varied in accordance with the thickness of the recording medium 22. Furthermore, the upper end face supporting roller 36*a* can be moved upward and downward in accordance with the size of the recording medium 22 (the recording width), and the position of the upper end face supporting roller 36*a* is variable.

The recording unit 16 has a pair of recording heads (liquid ejection heads) 38 which record onto either surface of the recording medium 22, and a pair of UV light sources 40 which cure and fix the ink (UV-curable ink) by irradiating UV light onto both sides of the recording medium 22. The print heads 38 include two print heads 38 disposed in the conveyance path of the recording medium 22. Nozzle surfaces (ink ejection surfaces) of the print heads 38 face each other, and the print heads 38 are disposed on either side of the recording medium 22 in a vertical position, which is conveyed from the front conveyance unit 14. Hence the print heads 38 can record images simultaneously onto both surfaces of the recording medium 22. The UV light sources 40 include two UV light sources 40 facing each other, the two UV light sources 40 being disposed on either side of the recording medium 22, after the print heads 38. End face supporting rollers 42 (42*a* and 42*b*) which support the upper and lower ends of the recording medium 22 are disposed between the print heads 38 and the UV light sources 40.

Although only one set of print heads 38 is depicted in FIG. 1 in order to simplify the description, it is in fact necessary to provide one set of print heads 38 for each color of ink. If recording is performed with four colors, namely, Y, M, C, and K, then four sets of print heads 38 corresponding to these ink colors are provided. The print heads 38 according to the present embodiment are long line heads, which have a recording width greater than the distance between the upper and lower ends of the recording medium 22 when the recording medium 22 is held vertically. The print heads 38 are disposed with their lengthwise direction oriented vertically, in such a manner that the print heads 38 can record over the whole surface of the recording medium 22 from the upper edge to the lower edge thereof.

When viewed from above, each of the print heads 38 is formed in a bracket shape as shown in FIG. 2, and includes a section corresponding to a nozzle surface 38*a* which projects toward the conveyance path for the recording medium indicated by the single-dotted line in FIG. 2, and a purge receiving cap section 38*b* which is formed in a recessed fashion with respect to section 38*a*. The pair of print heads 38 facing mutually is disposed in such a manner that each of the projecting nozzle surfaces 38*a* faces each of the recessed purge receiving cap sections 38*b*, and the print heads can be moved so as to vary the distance between the print heads. In performing maintenance, the print heads 38 with bracket shape are moved close toward each other, the nozzle surfaces 38*a* and the purge receiving cap sections 38*b* face each other, and then purging from the nozzles of the nozzle surface 38*a* toward the purge receiving cap sections 38*b* is carried out.

The UV light sources 40 are also composed, in such a manner that the distance between the UV light sources 40 can be altered in accordance with the thickness of the recording medium 22. Furthermore, desirably, the print heads 38, the conveyance rollers 34, the end face supporting rollers 36, and the like, are composed so as to be movable in an integrated fashion. In this case, it is desirable to adopt a composition in which the rollers and heads of one set are fixed and the rollers and heads of the other set are moveable, thereby changing the distance therebetween, because this composition ensures better positional accuracy.

The recording medium 22 that has been recorded and fixed on both surfaces thereof is sent to the rear conveyance unit 18. The rear conveyance unit 18 includes end face supporting rollers 44 (44*a* and 44*b*) and conveyance rollers 46 (46*a* and 46*b*). The rear conveyance unit 18 conveys the recording medium 22 after recording, to the output unit 20, while holding the recording medium 22 in a vertical position.

The output unit 20 has a composition similar to that of the supply unit 12, and is composed in such a manner that the output unit 20 performs actions that are the opposite of those of the supply unit 12. Specifically, the output unit 20 takes the recording medium 22 transferred from the rear conveyance unit 18 in a vertical position, lays it down to a horizontal position, and then stacks it up for output.

Figure 4A:
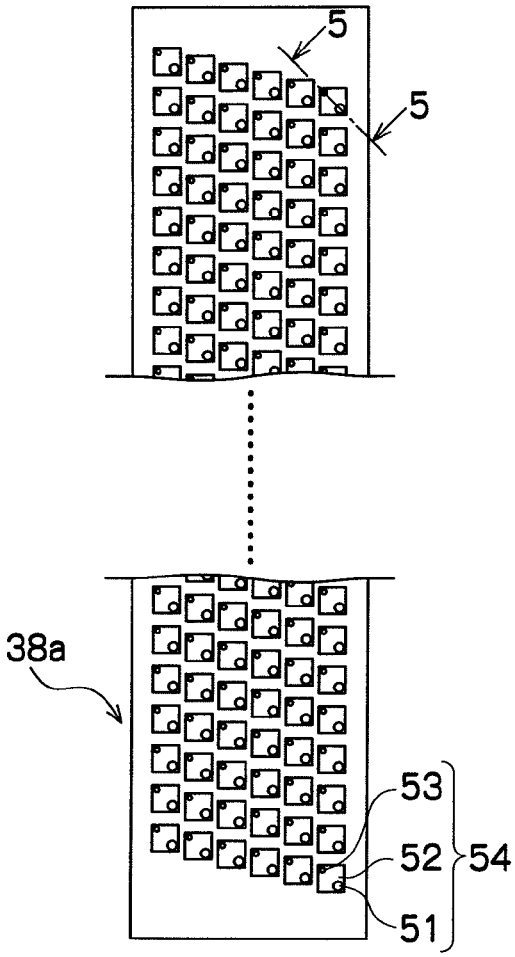
FIGS. 4A and 4B are plan view perspective diagrams showing examples of a nozzle arrangement on a nozzle surface of a print head.
Figure 4B:
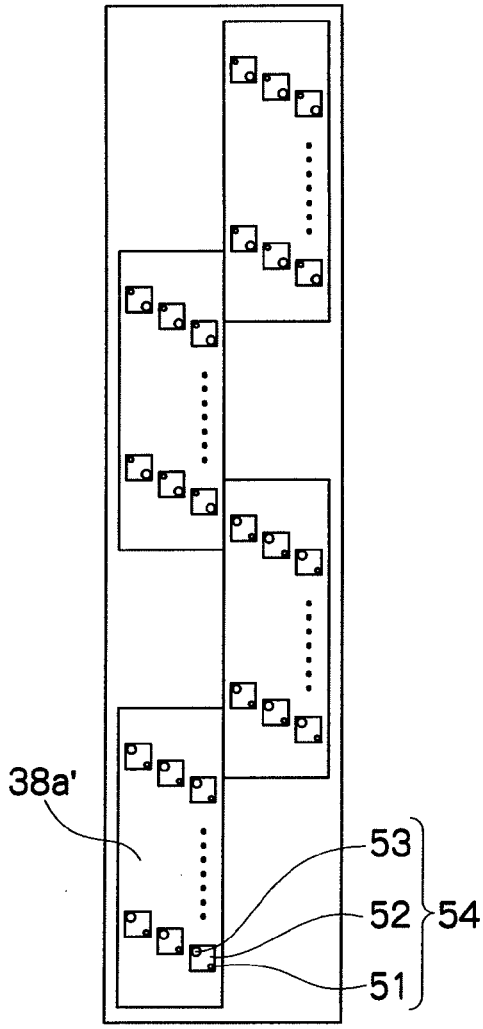

FIGS. 4A and 4B show the nozzle surface (ink ejection surface) 38*a* of a print head 38. FIG. 4A is a plan view perspective diagram of the nozzle surface 38*a* showing one structural example of a print head 38.

In the example of the print head 38 shown in FIG. 4A, a high density arrangement of nozzles 51 is achieved by using a two-dimensional staggered matrix array of pressure chamber units 54. Each of the pressure chamber units 54 includes a nozzle 51 for ejecting ink as ink droplets, a pressure chamber 52 for applying pressure to the ink in order to eject ink, and an ink supply port 53 for supplying ink to the pressure chamber 52 from a common flow channel.

Furthermore, as shown in the diagrams, when the pressure chamber 52 is viewed from above, the planar shape thereof is a substantially square shape. The nozzle 51 is formed at one end of a diagonal of the pressure chamber 52, while the supply port 53 is provided at the other end thereof. The planar shape of the pressure chamber 52 is not limited to being a square shape of this kind.

Furthermore, FIG. 4B is a plan perspective diagram of the ink ejection surface 38*a* showing a further example of the structure of the print head 38. As shown in FIG. 4B, one long full line head such as that shown in FIG. 4A may be constituted by combining a plurality of short heads 38*a*' arranged in a two-dimensional staggered array.

Figure 5A:
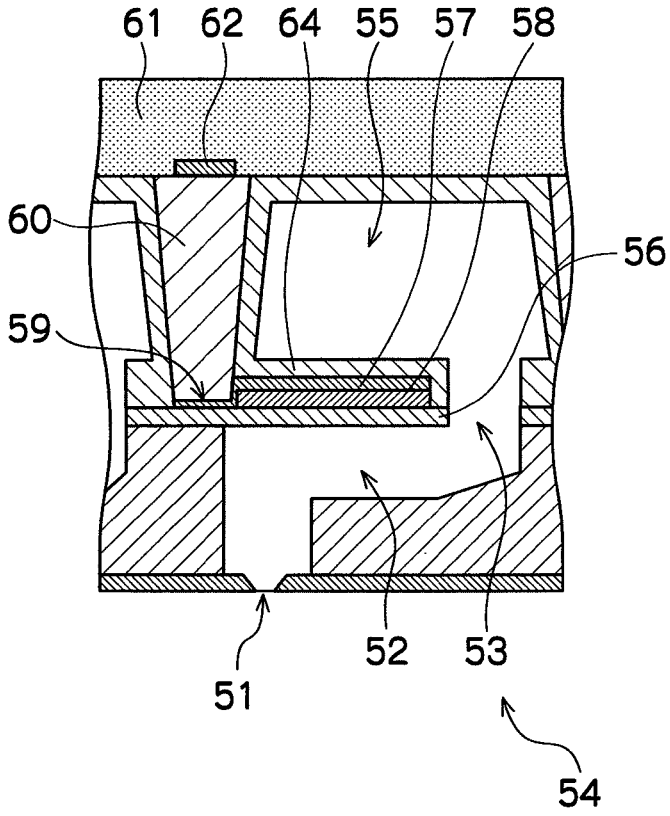
FIGS. 5A and 5B are cross-sectional diagrams showing examples of pressure chamber units.
Figure 5B:
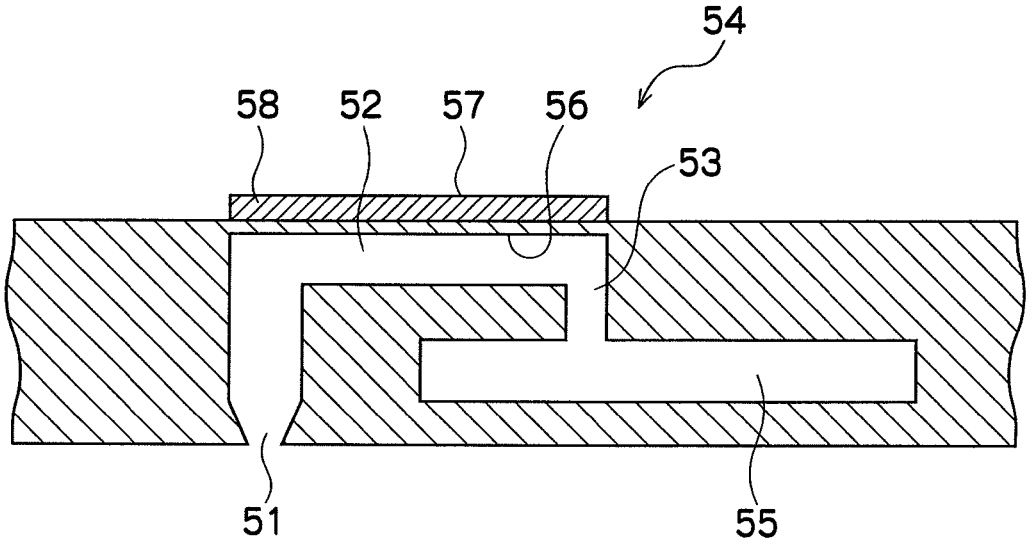

FIGS. 5A and 5B show side cross-sectional views of one pressure chamber unit 54, taken along line 5-5 in FIG. 4A. The structure of the pressure chamber units 54 is not limited in particular, and in this specification, two examples are shown in FIG. 5A and FIG. 5B.

In the example shown in FIG. 5A, a high density is achieved by disposing a common liquid chamber on the opposite side of the pressure chambers 52 from the nozzles 51, and the wires to the individual electrodes which drive the piezoelectric elements are passed through this common liquid chamber in a direction perpendicular to the surface on which the piezoelectric elements are formed.

As shown in FIG. 5A, each of the pressure chamber units 54 of the print head 38 includes a pressure chamber 52 connected to a nozzle 51. A common liquid chamber 55 is formed on the opposite side of the diaphragm 56 from the pressure chambers 52, the diaphragm 56 forming the upper surface of the pressure chamber 52 (in FIG. 5A). The common liquid chamber 55 and the pressure chambers 52 are connected directly by ink supply ports 53 formed in a portion of the diaphragm 56.

Furthermore, a piezoelectric body 58 and an individual electrode 57 for driving the piezoelectric body 58 are formed on each of the diaphragms 56 at positions corresponding to each of the pressure chambers 52. A wire 60 for supplying drive signals to the individual electrode 57 is formed in a column shape, and extends from a electrode pad 59 extending from each individual electrode 57, substantially perpendicularly to the surface on which the piezoelectric body, so as to pass through the common liquid chamber 55. The other end of the wire 60 is connected to a multi-layer flexible cable 61 via an electrode pad 62.

In this way, in the example shown in FIG. 5A, a common liquid chamber 55 is formed on the opposite side of the diaphragm 56 from the pressure chambers 52 (namely, the opposite side of the pressure chambers 52 with respect to the nozzles 51), and is connected directly to the pressure chambers 52. Accordingly, it is not necessary to provide tubing and the like for leading the ink to the pressure chambers from the common liquid chamber, as required in general. In addition, the size of the common liquid chamber can be increased, thereby ensuring a reliable supply of ink. Furthermore, the nozzles can be formed to a high density and high-frequency driving can be achieved, even if the nozzles are formed to high density. Moreover, since the wires 60 that supply signals for driving the piezoelectric bodies 58 are formed substantially perpendicularly to the surface on which the piezoelectric bodies are formed, it is possible to achieve a high density of the wires for supplying drive signals to the piezoelectric elements, and high-density arrangement of the nozzles 51 becomes easier to achieve.

Since the common liquid chamber 55 is filled with ink, an insulating and protective film 64 is formed on the surface portions of the diaphragm 56, individual electrodes 57, piezoelectric bodies 58, wires 60, and a multi-layer flexible cable 61 that make contact with the ink.

Furthermore, the structure of the pressure chamber units 54 is not limited in particular to that shown in FIG. 5A, and the structure shown in FIG. 5B may also be adopted.

In the pressure chamber unit 54 shown in the example in FIG. 5B, a common liquid chamber 55 is disposed on the same side of the pressure chambers 52 as the nozzles 51. Each pressure chamber 52 is connected to a nozzle 51, and is also connected to a common flow passage 55 via the supply port 53. The common flow channel 55 is connected to an ink tank that forms an ink source, and the ink supplied from the ink tank is delivered through the common flow channel 55 to the pressure chambers 52. Each of the ceiling faces of the pressure chambers 52 is constituted by a thin diaphragm 56, and a piezoelectric body 58 and an individual electrode 57 are formed on top of each diaphragm 56. In this example, a wiring (not illustrated) which supplies a drive signal to the individual electrode 57 is formed in parallel with the surface on which the piezoelectric bodies are formed.

Figure 6:
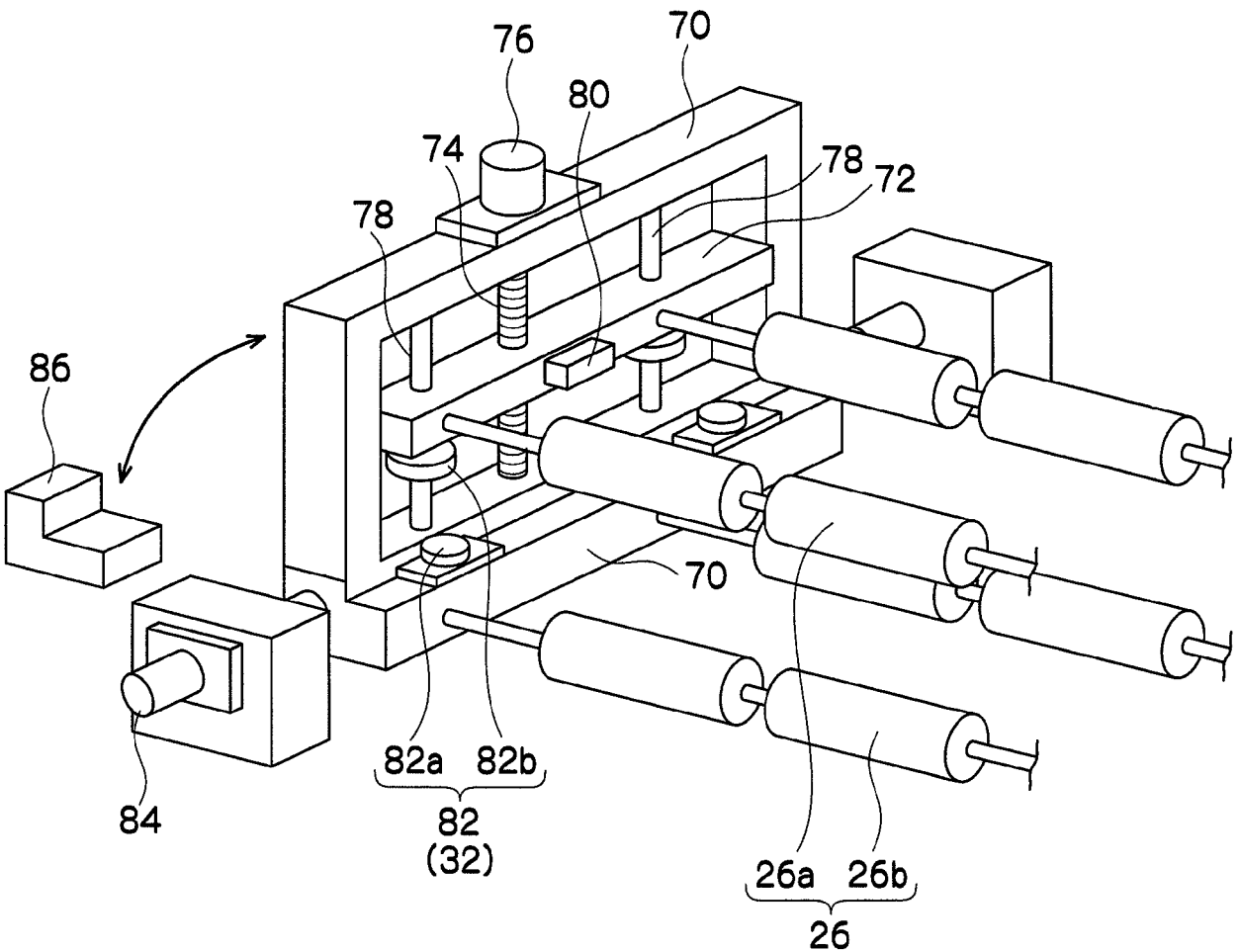
FIG. 6 is an enlarged oblique diagram showing a mechanism for rotating a recording medium in a recording medium supply unit, in such a manner that the recording medium is arranged in a vertical position.

FIG. 6 is an oblique diagram showing an enlarged view of a mechanism in which the gripping rollers 26 of the conveyance unit 12 rotate and raise up to a vertical position while holding a recording medium (not illustrated in FIG. 6).

FIG. 6 shows a case where the gripping rollers 26 are in a horizontal state, as indicated by the solid lines in FIG. 1. The gripping rollers 26 are constituted by pairs of gripping rollers 26*a* and 26*b* for holding a recording medium 22 (not illustrated in FIG. 6), from either side thereof. One end of one of the gripping rollers 26*a* is supported by a supporting member 72 that is movably disposed in a frame body 70. One end of the other gripping roller 26*b* is supported on the frame body 70.

A ball screw 74 passes through the center of the supporting member 72, in such a manner that the supporting member can be moved along guide shafts 78 upward or downward (in terms of the drawing) in the frame body 70, by means of a roller interval alterable motor 76. By moving the supporting members 72, it is possible to change the distance between the pairs of gripping rollers 26*a* and 26*b*, and by adjusting the distance between the pairs of gripping rollers 26*a* and 26*b* in accordance with the thickness of the recording medium 22, it is possible to hold the recording medium securely.

Furthermore, in order to adjust the distance between the rollers, a thickness sensor 80 is disposed on the supporting member 72 in order to optically measure the distance from the surface of the recording medium.

Moreover, supporting rollers 82 (82*a* and 82*b*) are provided in the portion of the frame body 70 which supports the supporting member 72 and one end of the gripping roller 26*b*. When the gripping rollers 26 are raised up to a vertical position while gripping the recording medium 22, the supporting rollers 82 support the recording medium 22 from below. The supporting rollers 82 forms the lower side guide 32 described above.

Furthermore, as shown in FIG. 6, the frame body 70 is provided with a rotational motor 84 that rotates the frame body 70 and the gripping rollers 26. By rotating the frame body 70 by means of the rotational motor 84, the gripping rollers 26 can be moved between a horizontal position and a vertical position. Furthermore, a vertical stopper 86 is provided in order to reliably hold the gripping rollers 26 in a vertical position when they have been raised to a vertical position.

Figure 7:
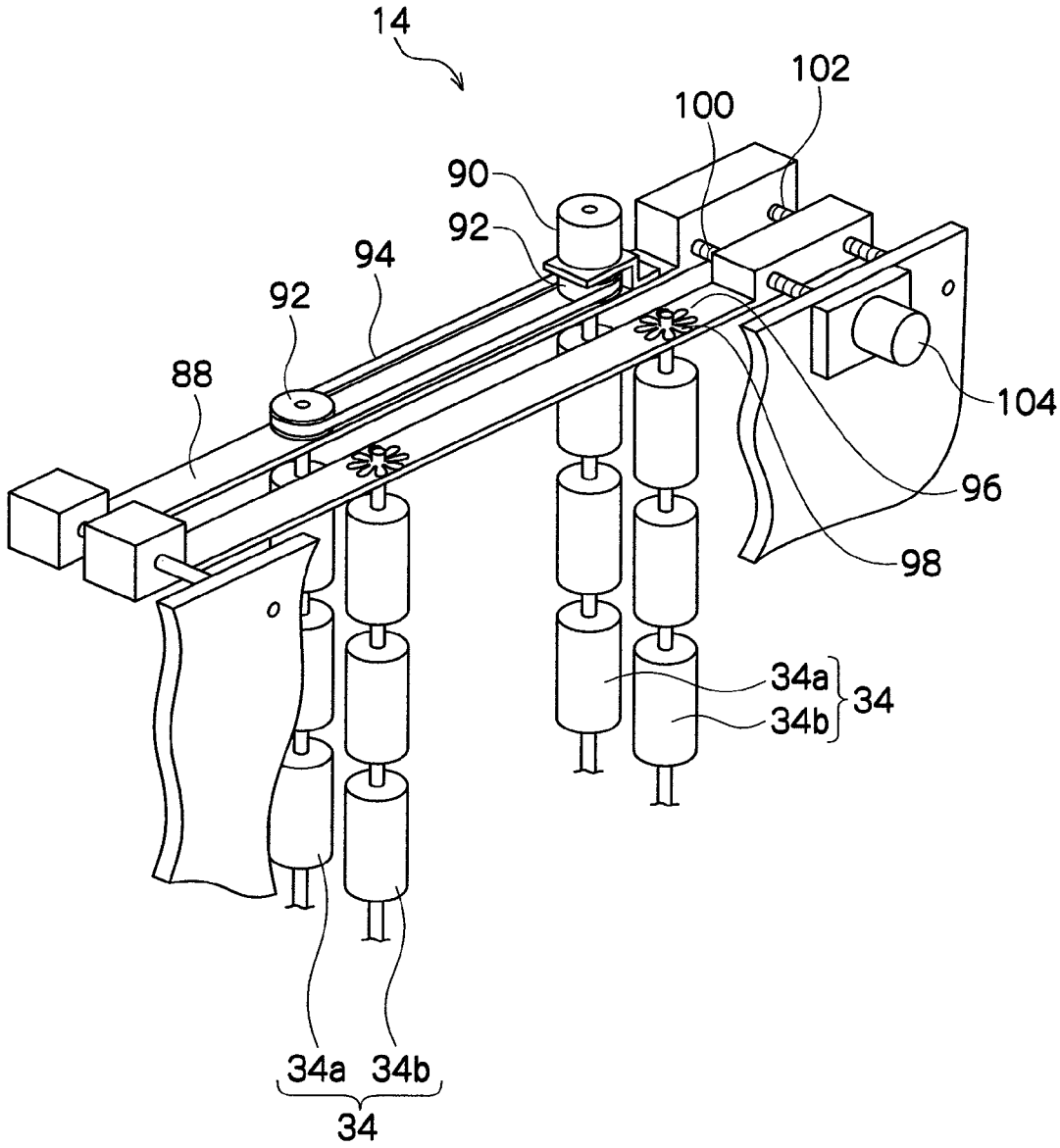
FIG. 7 is an enlarged oblique diagram showing a conveyance device.

FIG. 7 is an oblique diagram showing an approximate view of a roller interval alterable mechanism of the conveyance rollers 34 of the front conveyance unit 14.

As shown in FIG. 7, the conveyance rollers 34 include conveyance rollers 34*a* forming driving rollers, and conveyance rollers 34*b* forming idle rollers. While being conveyed, the recording medium 22 (not illustrated in FIG. 7) in a vertical position is supported from both sides and held by the conveyance rollers 34*a* and 34*b*.

One end of the conveyance rollers 34*a* forming the drive rollers is supported by a fixed supporting member 88, and the upper end thereof is provided with a timing pulley 92, a timing belt 94 being wound around the timing pulleys 92 and 92. One of the driving conveyance rollers 34*a* is connected to a roller drive motor 90 and rotated by the roller drive motor 90, and the rotational driving force of the roller drive motor 90 is transmitted to the other driving conveyance roller 34*a* via the timing belt 94.

Furthermore, one end of each of the idle conveyance rollers 34*b* is supported by a movable supporting member 96, and is movably held while given a nip pressure by means of a nip spring 98. The movable supporting member 96 is provided with ball a screw 100 and a guide shaft 102. By rotating the ball screws 100 by means of the roller interval alterable motor 104, it is possible to change the distance between the movable supporting member 96 and the fixed supporting member 88. By altering the distance between the movable supporting member 96 and the fixed supporting member 88, it is possible to vary the distance between driving conveyance rollers 34*a* and the idle conveyance rollers 34*b*.

The distance between the conveyance rollers 34*a* and 34*b* is adjusted in accordance with the thickness of the recording medium 22, and thereby the recording medium 22 is reliably conveyed while being held in a vertical position. In this case, the thickness of the recording medium 22 has already been measured by means of the thickness sensor 80 in the supply unit 12 described above (see FIG. 6). Furthermore, information relating to the size and thickness of the recording medium 22, and the like, can also be input separately by an operator.

Furthermore, the front conveyance unit 14 conveys the recording medium 22 while holding the recording medium 22 in a vertical position. Hence, if the recording medium 22 is heavy, then it is necessary to support the lower end of the recording medium 22 reliably. Considering these facts, it is required that the conveyance rollers 34*a* and 34*b* are adjusted. In addition, it is required that distances between rollers of the supporting rollers 82 forming the lower side guide 32 and between rollers of the end face supporting rollers 36, are set to be variable and be adjusted appropriately. Although not shown in FIGS. 1 to 3, in order to support the lower end of the recording medium 22, a lower side guide 32, in addition to the end face supporting rollers 36, 42 and 44, may be disposed on the lower side of the conveyance path from the front conveyance unit 14 to the rear conveyance unit 18. The lower side guide 32 is described below.

In the above-described example shown in FIG. 6, the distances between the rollers of the supporting rollers 82, which form the lower side guides 32 and support the lower end of the recording medium 22, are adjusted in conjunction with the adjustment of the roller distance between the gripping rollers 26 (26*a* and 26*b*).

Figure 8:
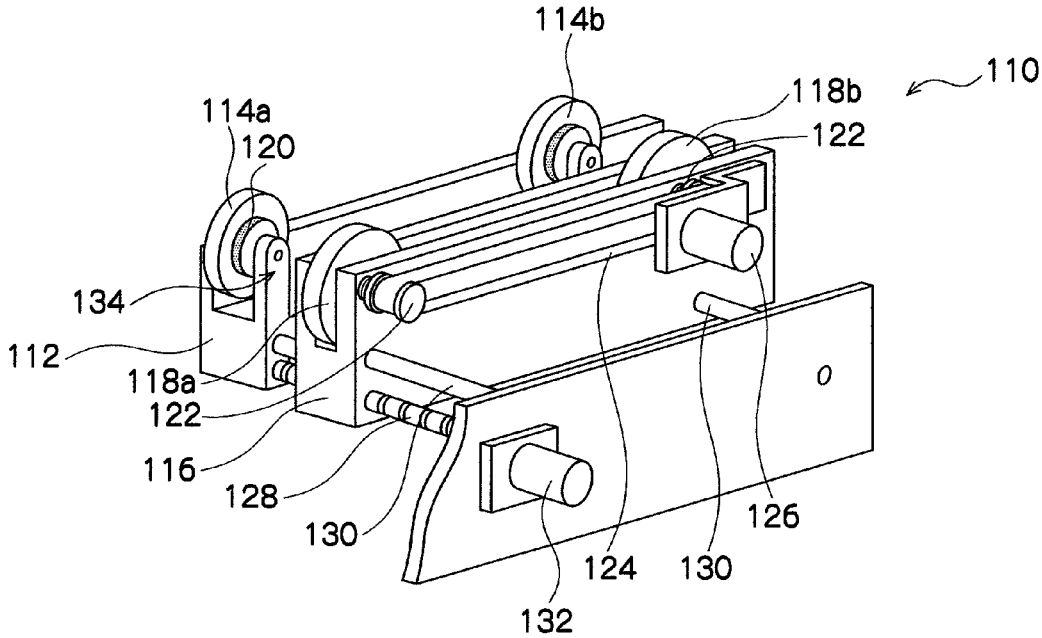
FIG. 8 is an enlarged oblique diagram showing one example of an end face supporting device.

FIG. 8 shows an example of a lower side guide (end face supporting device) which supports the lower end of the recording medium 22 and can adjust a distance between the rollers. The lower side guide 110 shown in FIG. 8 includes supporting rollers 114*a* and 114*b* installed rotatably on a fixed member 112, and supporting rollers 118*a* and 118*b* installed rotatably on a movable member 116.

Each of the supporting rollers 114*a*, 114*b*, 118*a*, and 118*b* has a stepped shape that two circular cylindrical (or circular disc-shaped) members are combined with each other, one with a large diameter being on the outer side and the other with a small diameter being on the inner side. A rubber 120 is applied to the face of the small diameter cylinder on the inner side, in such a manner that the lower end face of the recording medium 22 is supported by this rubber portion 120.

Timing pulleys 122 and 122 are installed respectively on the supporting rollers 118*a* and 118*b*, and a timing belt 124 is wound around these timing pulleys 122 and 122. A motor 126 is connected to one of the support rollers (e.g., supporting roller 118*b*), in such a manner that the supporting rollers 118*b* and 118*a* are rotated by the motor.

Furthermore, a ball screw 128 and guide shafts 130 are provided in the movable member 116. By rotating the ball screws 128 with the supporting roller interval alterable motor 132, the movable member 116 is moved along the guide shafts 130 in such a manner that the distance between the fixed member 112 and the movable member 116 can change.

In this way, it is possible to change the distance between the fixed member 112 and the movable member 116, and thereby the distance between the supporting rollers 114 (114*a* and 114*b*) and the supporting rollers 118 (118*a* and 118*b*) can be changed. Consequently, it is possible to adapt the apparatus to recording media 22 of different thicknesses. It is desirable that the supporting rollers 114 and 118 have independent roller interval alterable mechanisms as described above, because this makes it possible to optimize the conveyance of the medium by the nip interval between the drive rollers, and to optimize the holding of the medium by the supporting rollers in accordance with the thickness of the recording medium.

Figure 9:
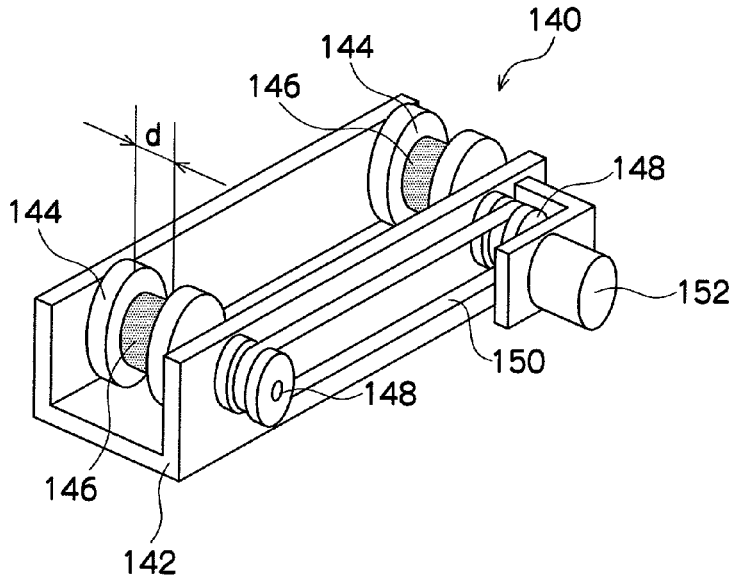
FIG. 9 is an enlarged oblique diagram showing one example of an end face supporting device having a fixed size.

In the lower side guide 110 shown in FIG. 8, members for installing the supporting rollers 114 (114*a* and 114*b*) and 118 (118*a* and 118*b*) are necessary (such as the member indicated by reference numeral 134 in FIG. 8, and the like), and hence a distance between the rollers cannot be reduced beyond a certain level. In view of the circumstances, a plurality of lower side guides 140 which have different sizes and the fixed distance d between the rollers, and are formed as units as shown in FIG. 9, may be formed. These lower side guide 140 units are changed in accordance with the thickness of the recording medium 22. In this case, it is possible to broaden the range of the choice for the thicknesses of the recording medium 22 that is compatible with the apparatus.

In the lower side guide 140 shown in FIG. 9, bobbin-shaped supporting rollers 144 are rotatably supported on a frame body 142 having a cross-section in the form of a square U-shaped and a gutter-form. Rubber pieces 146 are attached to the recessed sections in the centers of the supporting rollers 144, in such a manner that the lower end face of the recording medium 22 is supported by these sections.

Each of the supporting rollers 144 is provided with timing pulley 148, and a timing belt 150 is wound around the timing pulleys 148. One of the supporting rollers 144 is rotated by a motor 152. By adopting a lower side guide 140 formed into a unit in this way, it is possible to adapt even to thin media having a thickness of approximately 1 mm to 10 mm. Thus, this apparatus is particularly valuable for supporting a thin recording medium 22.

The compositions of the rear conveyance unit 18 and the output unit 20 are similar to the compositions of the front conveyance unit 14 and the supply unit 12, respectively. In other words, the compositions of the rear conveyance unit 18 and the output unit 20 have substantially the same structure as the supply unit 12 and the output unit 20, having a composition in which the supporting rollers and the driving conveyance rollers are integrated and distance between the rollers can be altered in accordance with the thickness of the recording medium. Furthermore, in order to ensure the positional accuracy of the supply system and the conveyance system, desirably, the fixed-side supply rollers and drive rollers are located on the same side as the fixed-side rollers of the conveyance system in the vicinity of the head.

Figure 10:
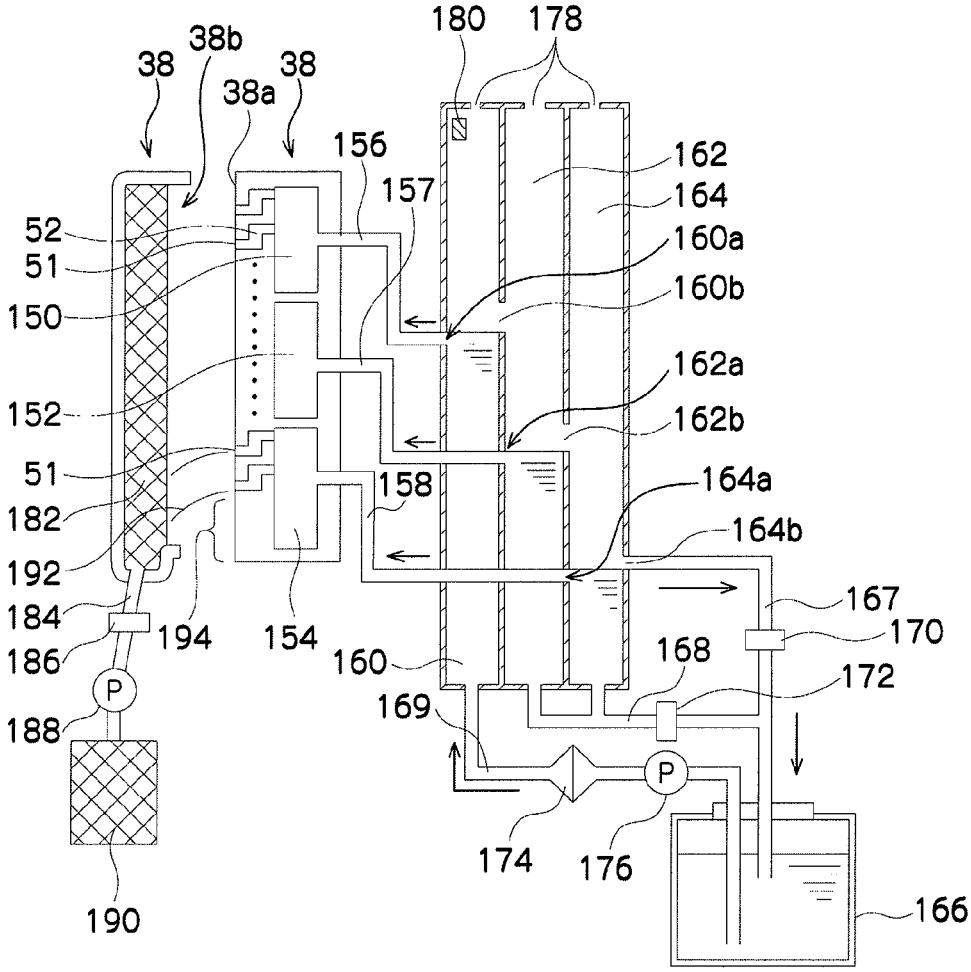
FIG. 10 is a general schematic drawing showing an ink supply system.

Next, the composition of the ink supply system in the inkjet apparatus 10 for double-side recording according to the present embodiment is described below. FIG. 10 shows an approximate view of the ink supply system in the present embodiment.

As described above, the print heads 38 in the present embodiment are long line heads, which are disposed with their lengthwise direction oriented longitudinally. Furthermore, as shown in FIG. 1 or FIG. 2, the print heads 38 of one set are disposed on either side of the conveyance path of the recording medium 22, in such a manner that the nozzle surface (ejection surface 38*a*) of each set opposes the purge receiving cap section (liquid recovery device) 38*b* of the set.

In other words, in FIG. 10, the nozzle surface 38*a* of one print head 38 of the set of print heads 38 opposes the purge receiving cap section 38*b* of the other print head 38. If the general liquid chamber 55 for supplying ink to the pressure chambers 52 is formed as one single interconnected common liquid chamber throughout the whole of the head, the negative pressure balance applied to the nozzles 51 differs between the upper and lower parts of the print head 38 and even printing is difficult, because the print heads 38 are line heads arranged vertically. Hence, as shown in FIG. 10, the common liquid chamber 55 is divided into a plurality of chambers (in this case, three chambers) in the vertical direction, thus creating a first common liquid chamber 150, a second common liquid chamber 152 and a third common liquid chamber 154.

The common liquid chambers 150, and so on, are connected respectively to the plurality of pressure chambers 52, and are also connected respectively to individual sub-tanks. The first common liquid chamber 150 is connected to a first sub-tank 160 via an ink flow channel 156, the second common liquid chamber 152 is connected to a second sub-tank 162 via an ink flow channel 157, and the third common liquid chamber 154 is connected to a third sub-tank 164 via an ink flow channel 158.

Each of the sub-tanks 160, 162, and 164 has a column shape and are disposed in a vertical direction, similarly to the print head 38. The sub-tanks 160, 162 and 164 are connected to a main tank 166. The first sub-tank 160 is provided with a connection port 160*a* connecting to the ink flow channel 156, and a first outlet port 160*b* for discharging ink to the second sub-tank 162. The first outlet port 160*b* connects the first sub-tank 160 with the second sub-tank 162. The position of the upper end of the connection port 160*a* and the position of the lower end of the first outlet port 160*b* are made to be substantially equivalent, in such a manner that the ink level inside the first sub-tank 160 is adjusted in the position of the connection port 160*a* which connects with the ink flow channel 156 when the print head 38 is driven to perform normal ejection.

Furthermore, similarly, the second sub-tank 162 is provided with a connection port 162*a* connecting to the ink flow channel 157, and a second outlet port 162*b* for discharging ink to the third sub-tank 164. The second outlet port 162*b* connects the second sub-tank 162 with the third sub-tank 164, and the position of the upper end of the connection port 162*a* and the position of the lower end of the second outlet port 162*b* are made to be substantially equivalent, in such a manner that the ink level inside the second sub-tank 162 is adjusted in the position of the connection port 162*a* which connects with the ink flow channel 157 when the print head 38 is driven to perform normal ejection.

Furthermore, similarly, the third sub-tank 164 is provided with a connection port 164*a* connecting to the ink flow channel 158, and a third outlet port 164*b* for discharging ink to the main tank 166. The third outlet port 164*b* connects the third sub-tank 164 with the main tank 166, via an ink flow channel 167, and the position of the upper end of the connection port 164*a* and the position of the lower end of the third outlet port 164*b* are made to be substantially equivalent, in such a manner that the ink level inside the third sub-tank 164 is adjusted in the position of the connection port 164*a* which connects with the ink flow channel 158 when the print head 38 is driven to perform normal ejection.

The connection port 160*a* between the first sub-tank 160 and the ink flow channel 156, which correspond to the first common liquid chamber 150 arranged at the highest position, is set at the greatest height, the connection port 162*a* between the second sub-tank 162 and the ink flow channel 157, which correspond to the second common liquid chamber 152, is set at the next greatest height, and the connection port 164*a* between the third sub-tank 164 and the ink flow channel 158, which correspond to the third common liquid chamber 154, is set at the lowest height.

Accordingly, due to the differences in the levels of the ink in the sub-tanks 160, 162 and 164 (namely, the differences in the liquid pressures at the heads), the negative pressure at the nozzles 51 of the print head 38 can be adjusted so as to be substantially uniform from the top to the bottom of the head.

The second sub-tank 162 and the third sub-tank 164 are connected to an ink flow channel 168 that connects to the main tank 166, in the base sections thereof. Furthermore, the first sub-tank 160 is connected to an ink flow channel 169 that connects to the main tank 166, in the base section thereof. A valve 170 is provided in the ink flow channel 167, a valve 172 is provided in the ink flow channel 168, and a filter 174 and a pump 176 are provided in the ink flow channel 169.

Furthermore, an atmospheric air connection hole 178 is provided in the upper part of each of the sub-tanks 160, 162 and 164, and a liquid level sensor 180 is provided in the upper part of the first sub-tank 160.

A porous member 182 for receiving ink, such as a sponge, is provided in the purge receiving cap section 38*b*. Furthermore, an ink flow channel 184 for expelling ink from the bottom section of the purge receiving cap section 38*b* is also provided, and a valve 186 and pump 188 are provided in this ink flow channel 184, in such a manner that the ink collected in the purge receiving cap section 38*b* is gathered into an ink recovery tank 190. A porous member may also be provided inside the ink recovery tank 190, and the gathered ink may be reused.

Furthermore, when ink droplets 192 ejected from the nozzles 51 by the implementation of purging (preliminary ejection) for preventing ejection errors are received in the purge receiving cap section 38*b*, the ink droplets 192 are ejected horizontally from the nozzles 51 and gradually fall downward under their own weight. As a result, it may occur that the ink droplets 192 ejected from the nozzles 51 in the lower part of the print head 38 are not received in the purge receiving cap section 38*b*. In order to prevent soiling of the periphery of the print head 38 in such cases, the nozzle positions in the nozzle surface 38*a* may be set in the upper part of the print head 38, a nozzle-free region 194 where no nozzles 51 is formed may be set in the lower part of the print head 38, and the purge receiving cap section 38*b* may also be extended on the lower side, to a position which is determined according to the effects of the falling of the ink droplets due to the effects of gravity.

Although described in more detail below, if a composition is adopted in which the purge receiving cap section 38*b* extends in the downward direction, or is movable in the downward direction, then it is not necessary to provide the aforementioned nozzle-free region 194.

Next, the actions of the ink supply system during initial filling of ink are described below.

Firstly, the print heads 38 of one pair, which face mutually, are moved close toward each other, in such a manner that the nozzle surface 38*a* of the one head interlocks with the purge receiving cap section 38*b* of the other head, thereby the nozzle surfaces 38*a* being capped.

Next, the valves 170 and 172 are closed, thereby setting the second sub-tank 162 and third sub-tank 164 to a state where they are not connected directly to the main tank 166. Thereupon, the pump 176 is driven and ink is raised up from the main tank 166, so that the ink is filled progressively into the first sub-tank 160 via the ink flow channel 169.

When the ink has flowed into the first sub-tank 160 to the level of the first outlet port 160*b*, the ink spills out via the first outlet port 160*b* and starts to fill into the second sub-tank 162. When the ink inside the second sub-tank 162 reaches the level of the second outlet port 162*b*, the ink spills out via the second outlet port 162*b*, and starts to fill into the third sub-tank 164.

When the ink level in the third sub-tank 164 has reached the third outlet port 164*b*, the ink level in the third sub-tank 164 continues to rise because the valve 170 and the valve 172 are closed. When the ink level reaches the level of the second outlet port 162*b*, the levels in the second and third sub-tanks 162 and 164 rise simultaneously. When these ink levels reach the level of the first outlet port 160*b*, then the ink levels in the first to third sub-tanks 160, 162 and 164 all rise simultaneously.

In this case, ink flows into the print head 38 in accordance with the levels in the common liquid chambers 150, 152 and 154. If ink leaks out from the nozzle 51 during the filling process, then the head is capped by the purge receiving cap section 38*b*, and the pump 188 is driven to pump out the ink.

If the liquid level sensor 180 determines that ink has been filled sufficiently into each of the sub-tanks 160, 162 and 164, then the driving of the pump 176 is halted. Alternatively, the driving of the pump 176 is halted on the basis of time monitoring.

Thereupon, by opening the valve 170, the level of the ink inside the third sub-tank 164 changes to the position of the third outlet port 164*b*. In this case, the ink level in the second sub-tank 162 is adjusted in the position of the second outlet port 162*b*, and the ink level inside the first sub-tank 160 is adjusted in the position of the first outlet port 160*b*. Thereby, the inks in the first to third common liquid chambers 150, 152 and 154 attains levels which create optimum negative pressure conditions, respectively.

In this way, the sub-tanks 160, 162 and 164 are disposed between the main tank 166 and the print head 38, and accordingly air bubbles are absorbed by the sub-tanks 160, 162 and 164 during initial filling. Thus, the introduction of air bubbles into the print head 38 is avoided, and it is possible to perform the stable ejections.

Next, actions during normal ejection driving are described below. In ejection driving, the valve 172 is closed, the valve 170 is left open, and in this sate, the pump 176 is driven at low-speed. Accordingly, ink gradually flows out from the main tank 166 through the ink flow channel 169, and flows into the first sub-tank 160 from the bottom of the first sub-tank 160. In other apparatuses, the ink level inside the first sub-tank 160 would rise when ink flows into the first sub-tank 160. In contrast, in this apparatus according to this embodiment, almost same amount of the ink as the amount of the ink supplied newly in the first sub-tank 166, is supplied to the first common liquid chamber 150 via the connection port 160*a* and the ink flow channel 156, as well as being discharged into the second sub-tank 162 via the first outlet port 160*b*. Consequently, the ink level in the first sub-tank 160 does not substantially change.

In this way, the ink expelled from the first outlet port 160*b* of the first sub-tank 160 increases the amount of ink inside the second sub-tank 162. Furthermore, in a similar fashion, almost same amount of the ink as the amount of the ink supplied newly in the second sub-tank 162, is supplied to the second common liquid chamber 152 via the connection port 162*a* and the ink flow channel 157, as well as being discharged into the third sub-tank 164 via the second outlet port 162*b*. Consequently, the ink level in the second sub-tank 162 does not substantially change.

The ink discharged from the second outlet port 162*b* of the second sub-tank 162 increases the amount of ink inside the third sub-tank 164. Furthermore, in a similar fashion, almost same amount of the ink as the amount of the ink supplied newly in the third sub-tank 164, is supplied to the third common liquid chamber 154 via the connection port 164*a* and the ink flow channel 158, as well as being discharged into the main tank 166 via the third outlet port 164*b* and the ink flow channel 167, because the valve 170 is open. Consequently, the ink level in the third sub-tank 164 does not substantially change.

In this way, during normal ejection, the ink level inside the first sub-tank 160 is substantially constantly maintained at the position of the connection port 160*a*, the ink level inside the second sub-tank 162 is substantially constantly maintained at the position of the connection port 162*a*, and the ink level inside the third sub-tank 164 is substantially constantly maintained at the position of the connection port 164*a*. Therefore, the negative pressure in each of the common liquid chambers 150, 152 and 154 is maintained appropriately, and stable ejections can be achieved.

Furthermore, the pump 176 is disposed between the main tank 166 and the sub-tanks 160, 162 and 164, and accordingly variation in the ink pressure due to the pump 176, and the like, is cancelled out by the sub-tanks 160, 162, and 164. Moreover, ink is supplied through the bottom of the particular (the first) sub-tank 160, and rippling of the ink surface in the (first) sub-tank 160 is suppressed. Therefore stable ejections can be achieved.

Moreover, the movement of the ink between the sub-tanks 160, 162 and 164 is based on the liquid pressure acting via the outlet ports 160*b* and 162*b*, and hence there is no need to provide pumps for moving the liquid and the number of pumps can be reduced.

Figure 11:
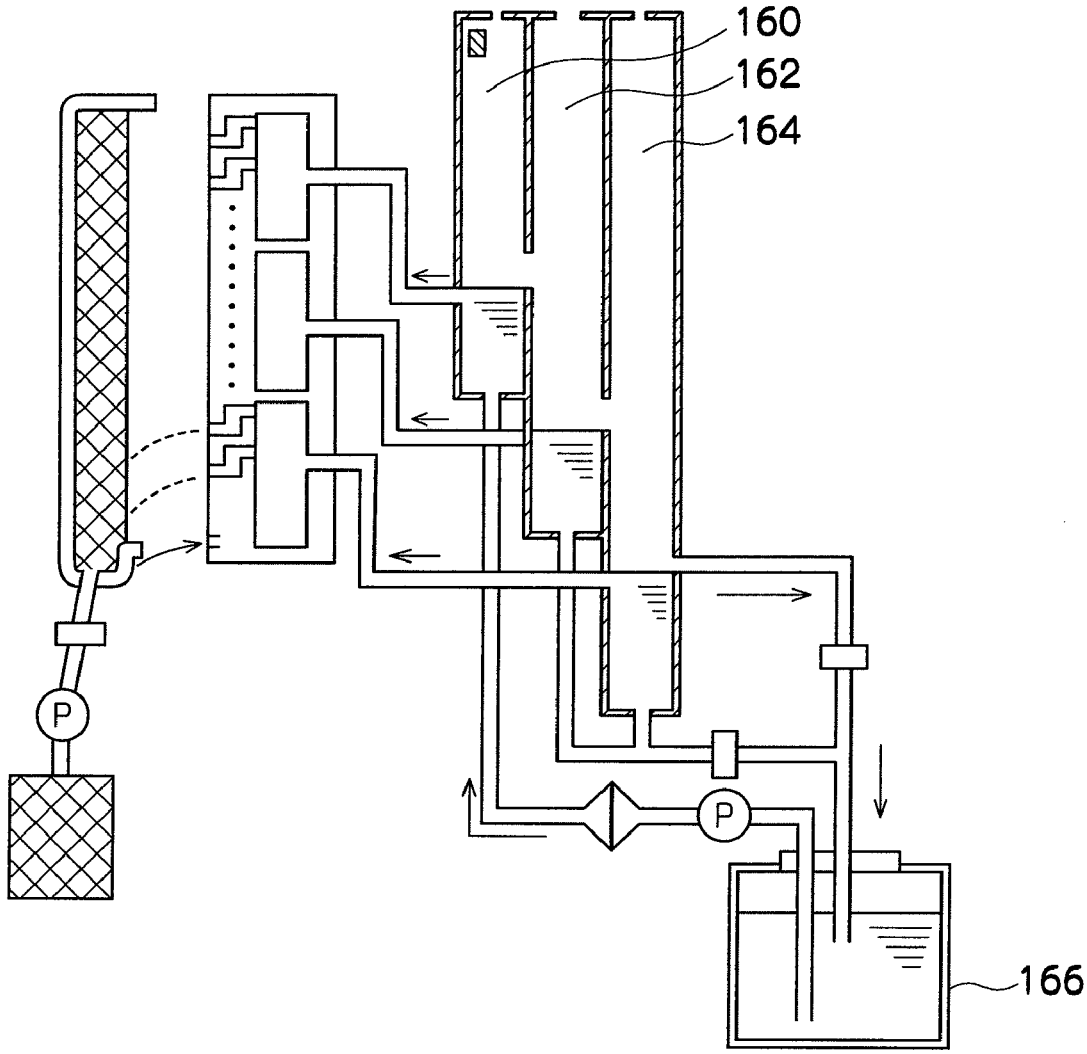
FIG. 11 is a general schematic drawing showing further example of an ink supply system.

There is no need to align the positions of the bottom faces of the sub-tanks 160, 162 and 164 as shown in FIG. 10, and the bottom faces of the sub-tanks may be at different positions, as shown in FIG. 11, for example. In this way, it is possible to reduce the amount of ink inside the sub-tanks 160, 162 and 164, by altering the shapes of the sub-tanks 160, 162 and 164.

In this way, the common liquid chamber is divided into a plurality of chambers in the vertical direction, and a plurality of sub-tanks is provided in accordance with the division of the common liquid chamber, so that the negative pressure is set with respect to each common liquid chamber. Accordingly, leaking of liquid from the nozzles can be prevented, and ejections can be stabilized.

Furthermore, if the print head 38 is a long line head formed by joining together a plurality of short heads (sub-heads) as shown in FIG. 4B, then a composition may be adopted in which the negative pressure is set by providing a plurality of sub-tanks for each of the sub-heads, regardless of one color of ink being used or different colors of inks being used. It is also possible to use one sub-tank for a plurality of sub-heads, provided that a negative pressure balance can be achieved.

Next, a second embodiment according to the present invention is described below.

In the present embodiment, shuttle type heads (serial type heads) which are heads that move back and forth reciprocally in a direction perpendicular to the direction of conveyance of the recording medium, are disposed on either side of the recording medium, in such a manner that double-side recording on a recording medium, which is conveyed while being held vertically, can be performed.

Figure 12:
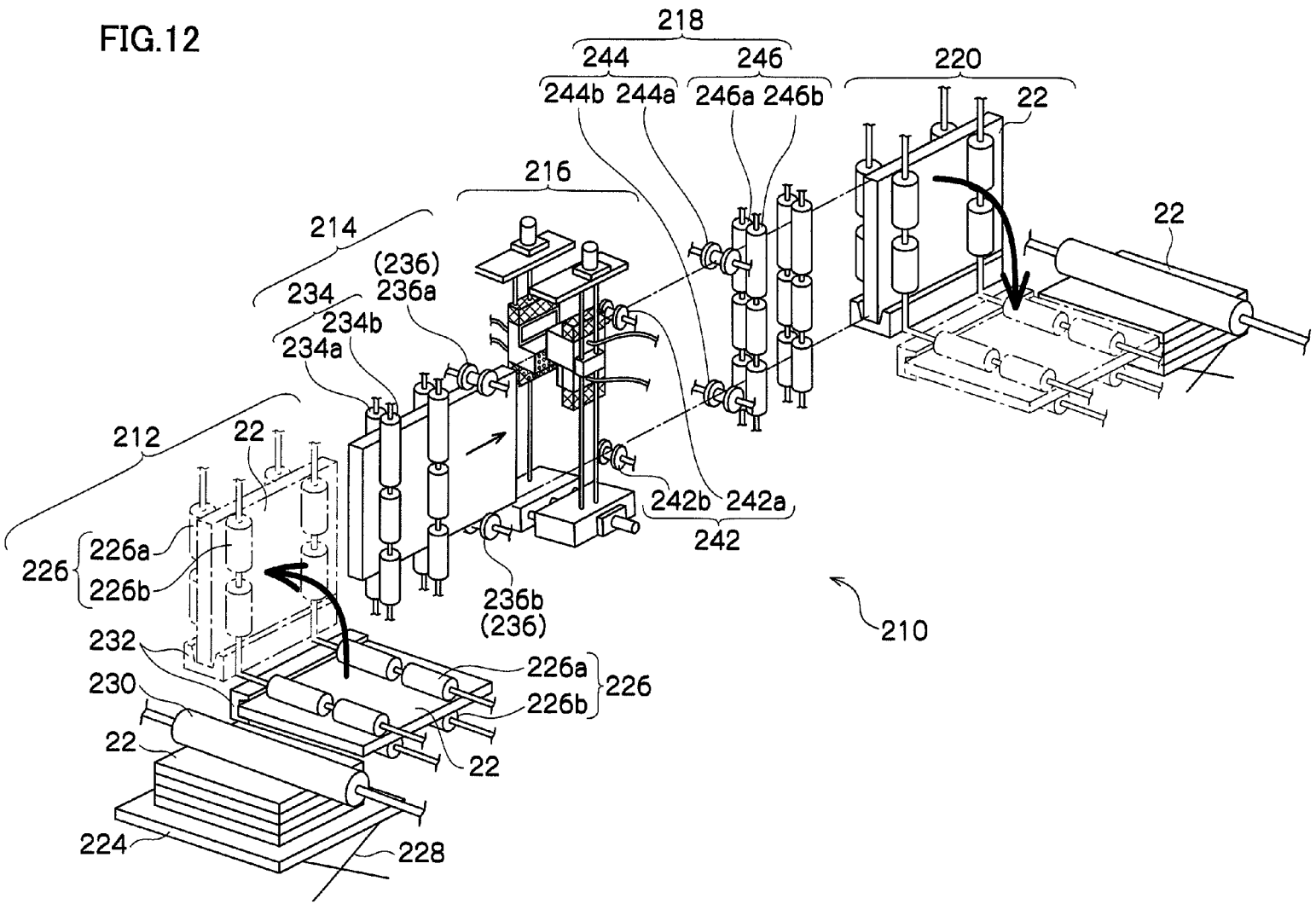
FIG. 12 is an oblique diagram showing the general composition of an inkjet apparatus for double-side recording using the image recording apparatus relating to a second embodiment according to the present invention.
Figure 13:
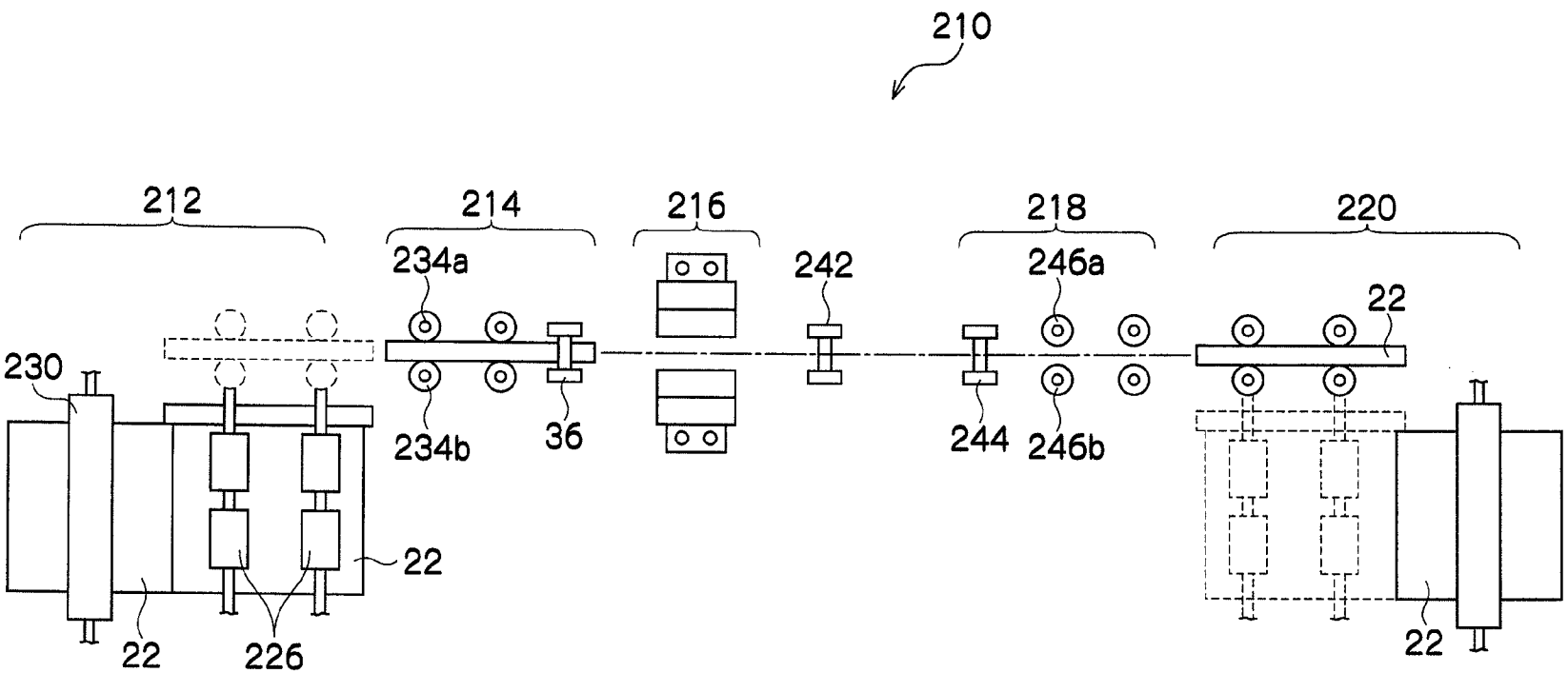
FIG. 13 is an upper side diagram showing a case where the inkjet apparatus for double-side recording shown in FIG. 12 is viewed from above.
Figure 14:
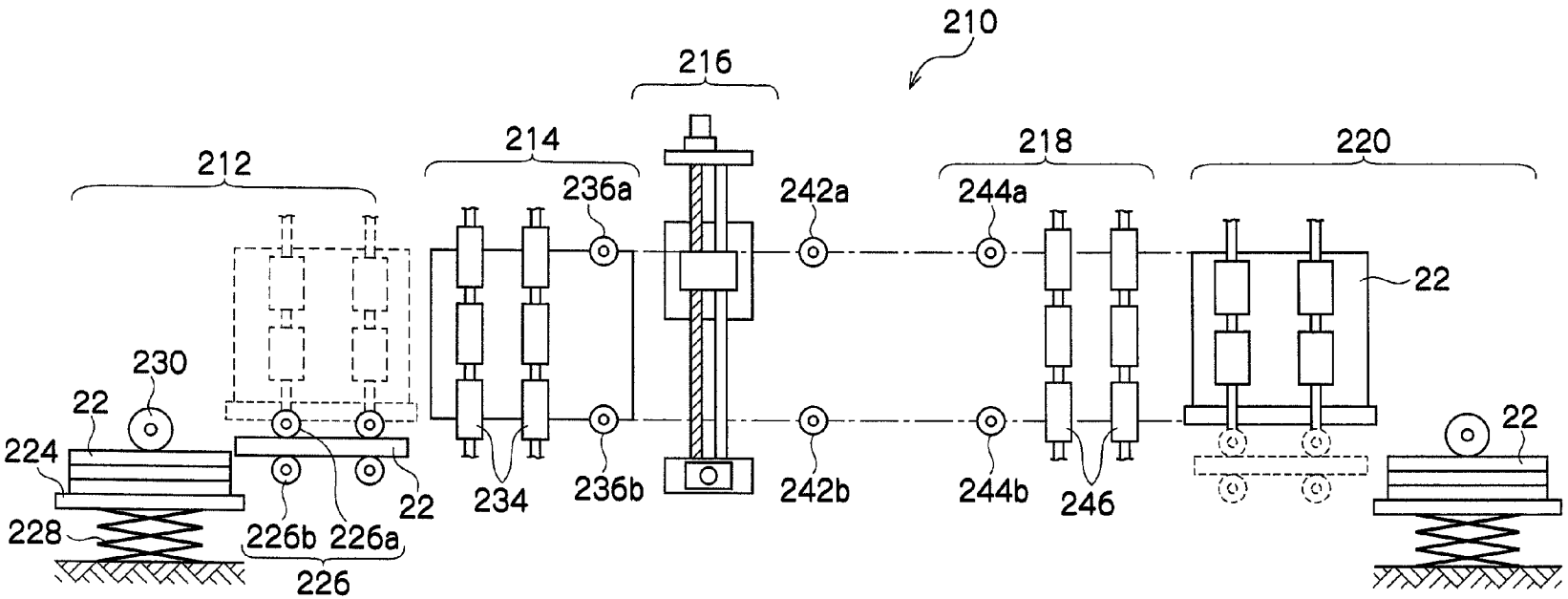
FIG. 14 is a side diagram showing a case where the inkjet apparatus for double-side recording shown in FIG. 12 is viewed from the right-hand side.

FIG. 12 is an oblique diagram showing the general composition of the inkjet apparatus for double-side recording using the image recording apparatus according to the second embodiment. FIG. 13 is an upper side view showing a situation where the inkjet apparatus for double-side recording shown in FIG. 12 is viewed from above. FIG. 14 is a side view showing a situation where the inkjet apparatus for double-side recording shown in FIG. 12 is viewed from the right-hand (front) side.

As shown in FIGS. 12, 13 and 14, the inkjet apparatus 210 for double-side recording according to the present embodiment includes a supply unit 212, a front conveyance unit 214, a recording unit 216, a rear conveyance unit 218, and an output unit 220.

The main points of difference of the present embodiment with respect to the above-described first embodiment are based on the following facts. More specifically, in the recording unit 216, a shuttle type head is used as a print head instead of a line head, and the UV light source is incorporated into the shuttle type print head. The other composition is similar to that of the first embodiment. Hence, only the shuttle type print head of the recording unit 216 is described below, and the supply unit 212 (including elements 224, 226 (226*a* and 226*b*) and 230), front conveyance unit 214 (including elements 234 (234*a* and 234*b*) and 236 (236*a* and 236*b*)), elements 242 (242*a* and 242*b*) of the recording unit 216, rear conveyance unit 218 (including elements 244 (244*a* and 244*b*) and 246 (246*a* and 246*b*)) and output unit 220 are labeled with the same last two digits as the reference numerals of the corresponding constituent elements in the first embodiment, detailed description thereof being omitted below.

Figure 15:
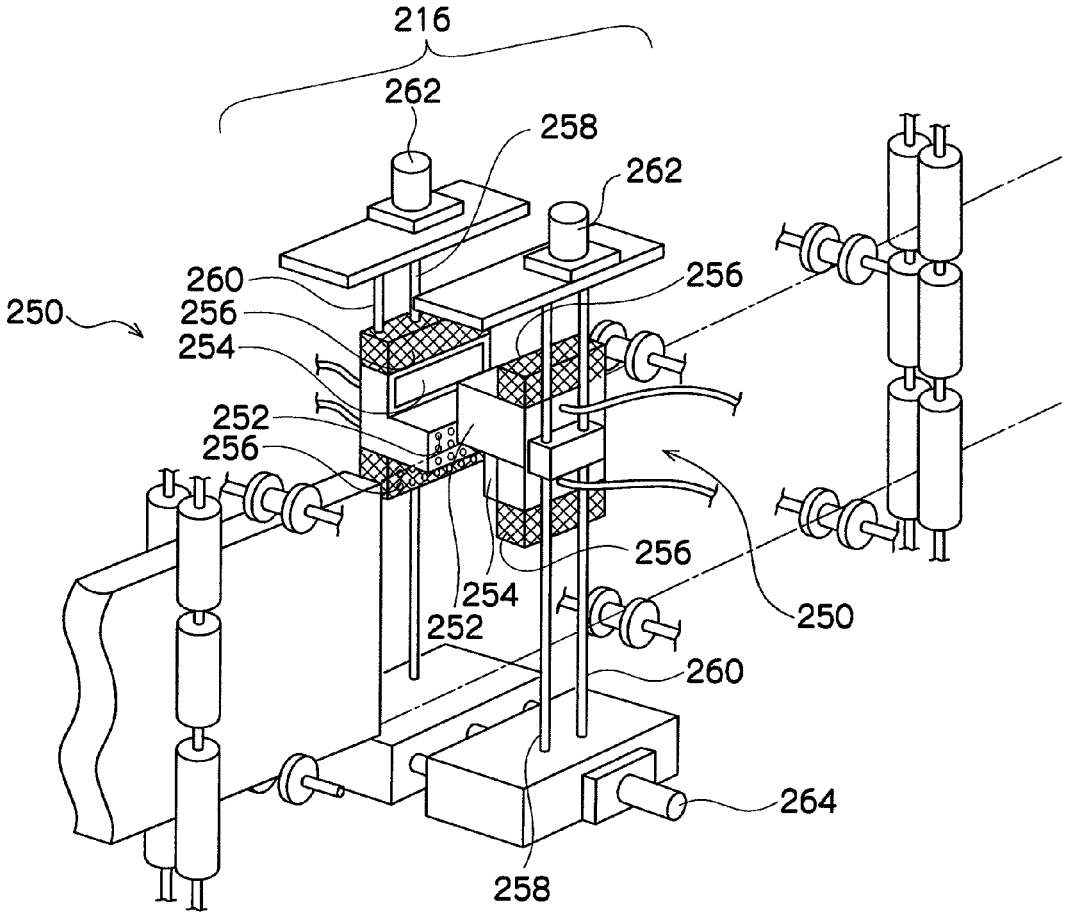
FIG. 15 is an enlarged oblique diagram showing a shuttle type print head in a recording unit according to the second embodiment.

FIG. 15 shows an oblique enlarged view of a recording unit 216 having a shuttle type print head.

As shown in FIG. 15, in the recording unit 216, a set of shuttle type print heads 250 are disposed on either side of the conveyance path of the recording medium 22 (indicated by the single-dotted line in FIG. 15) and are movable reciprocally (i.e., can shift up and down) in a direction substantially perpendicular to the conveyance direction, in such a manner that images can be recorded simultaneously onto both surfaces of the recording medium 22 conveyed while being held in a vertical position.

Each shuttle type print head 250 has a nozzle surface 252, a purge receiving cap section 254, and UV light sources 256. A plurality of nozzles ejecting ink are formed in a two-dimensional matrix-form, within the nozzle surface 252. In the embodiment shown in the diagram, the nozzles are arranged in such a manner that the lengthwise direction of the two-dimensional matrix is substantially perpendicular to the shuttle scanning direction.

The purge receiving cap section 254 is provided directly adjacently to the nozzle surface 252, and two UV light sources 256 are disposed at the two outermost ends. The sequence of the nozzle surface 252, purge receiving cap section 254, and UV light sources 256 is mutually opposite in the two shuttle type print heads 250 which face each other. In other words, as shown in FIG. 15, in one of the shuttle type print heads 250 (on the far side in the diagram), a UV light source 256, purge receiving cap section 254, nozzle surface 252 and UV light source 256 are arranged in this order from the upper side, whereas in the other shuttle type print head 250 (on the near side in the diagram), a LV light source 256, nozzle surface 252, purge receiving cap section 254 and UV light source 256 are arranged in this order from the upper side.

Each of the shuttle type print heads 250 is provided with a ball screw 258 and a guide shaft 260, in such a manner that the shuttle type print heads 250 can be moved up and down reciprocally in the vertical direction in FIG. 15 by means of a motor 262. Furthermore, a composition is also adopted in which the distance between the shuttle type print heads 250 can be adjusted by means of a motor 264 disposed at the foot of the recording unit 216.

Furthermore, the nozzle surface 252 projects further toward the recording medium conveyance path than the other portions of the head, in such a manner that the facing shuttle type print heads 250 can be fitted together so that the nozzle surface 252 of one head corresponds to the purge receiving cap section 254 of the other.

In this way, in each of the shuttle type print heads 250, the UV light sources 256 are disposed on both the upstream side and the downstream side in the shuttle scan direction. If the shuttle type print heads 250 perform recording by moving reciprocally in a substantially perpendicular direction with respect to the direction of conveyance of the recording medium 22, then UV light is irradiated onto the ink immediately after it has landed on the recording medium, by means of the UV light source 256 situated on the downstream side with respect to the nozzle surface 252 in terms of the direction of movement, and consequently the ink is fixed on the recording medium. By fixing the ink immediately after it has landed in this way, the deposited ink does not flow down on the surface of the recording medium 22 even when the recording medium 22 is conveyed vertically.

Furthermore, the vertical movement of the shuttle type print heads 250 is performed through a range that exceeds the end-faces of the recording medium 22, and thus full-surface recording is possible. Using shuttle type print heads 250 of this kind is useful for recording over large surface areas.

Figure 16:
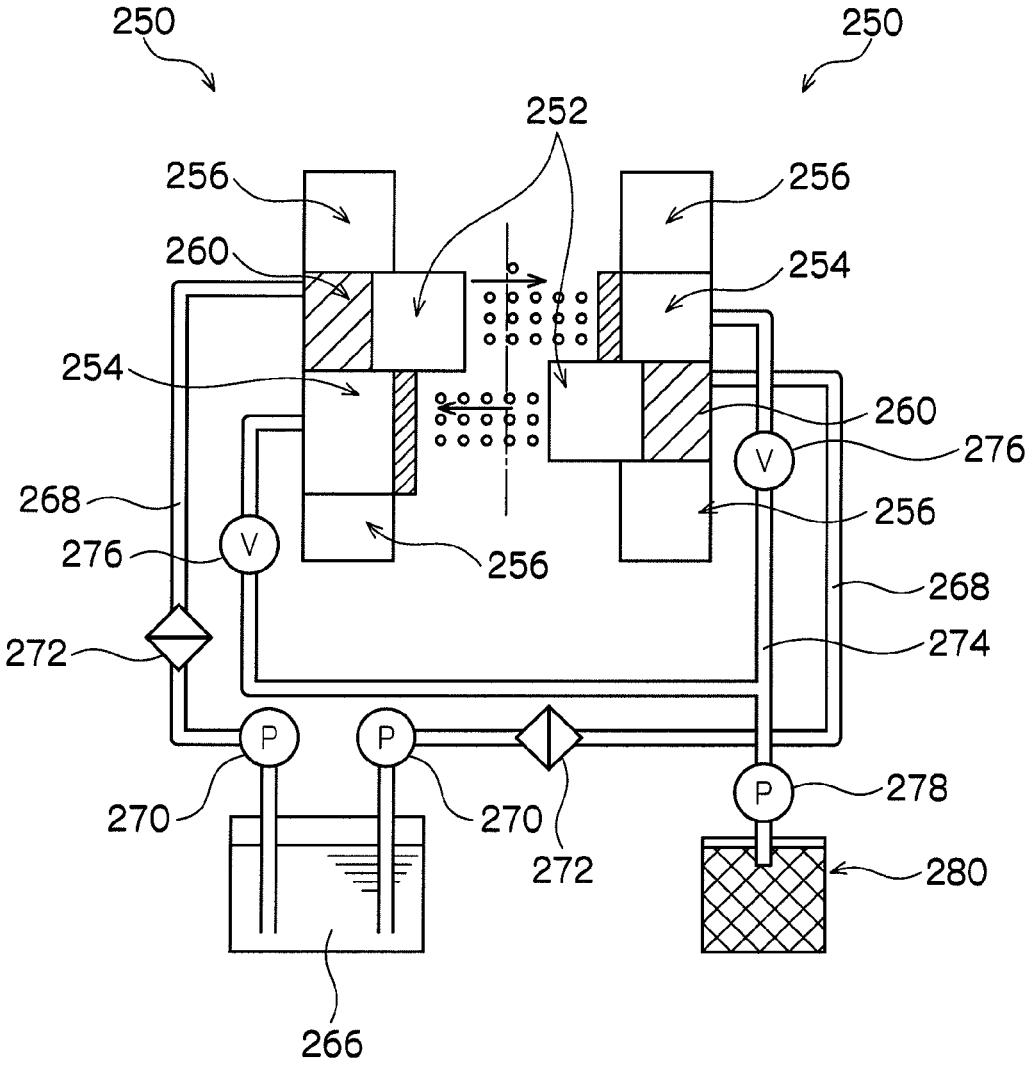
FIG. 16 is a general schematic drawing showing an ink supply system according to the second embodiment.

FIG. 16 shows an ink supply system and a purging situation in a shuttle type print head 250.

As shown in FIG. 16, one of the shuttle type print heads 250, for instance, the shuttle type print head 250 on the left-hand side in FIG. 16, includes, in order from the top side, a UV light source 256, a nozzle surface 252, a purge receiving cap section 254, and a UV light source 256. On the other hand, the other shuttle type print head 250, for instance, the shuttle type print head 250 on the right-hand side in FIG. 16, includes, in order from the top side, a UV light source 256, a purge receiving cap section 254, a nozzle surface 252 and a TV light source 256.

A sub-tank 260 is disposed behind each nozzle surface 252. In the case of the shuttle type print head 250 of this kind, each sub-tank 260 is incorporated into each shuttle type print head 250, and hence the negative pressure relationship is maintained even when the head moves upward and downward. Accordingly, leaking of ink from the nozzles can be prevented and stable ejection can be achieved.

Each sub-tank 260 is connected via an ink flow channel 268 to a main tank 266, and ink is pumped out of the main tank 266 by means of a pump 270, and supplied to the sub-tank 260 via a filter 272. Furthermore, the purge receiving cap section 254 is connected to an ink recovery tank 280 by way of an ink flow channel 274. A valve 276 and a pump 278 are provided in the ink flow channel 274. 15 During the purging, as shown in FIG. 16, the shuttle type print heads 250 are disposed facing each other, and the purging is carried out so that ink is ejected toward the purge receiving cap sections 254 facing the nozzle surfaces 252. By opening the valve 276 and driving the pump 278, ink collected in the purge receiving cap section 254 is gathered in the ink recovery tank 280.

Furthermore, during the pumping out the ink, each nozzle surface 252 is capped with the purge receiving cap section 254, and similarly, the ink is pumped out via the nozzle surface 252 by the pump 278. The ink gathered in the ink recovery tank 280 may be reused.

Figure 17:
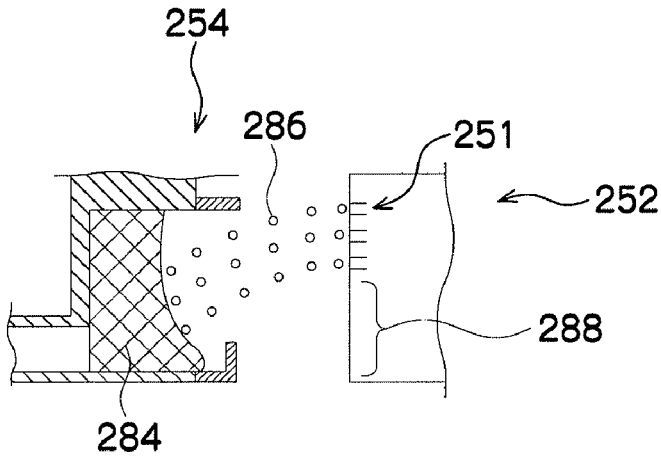
FIG. 17 is an illustrative diagram showing the situation of purging.

FIG. 17 shows an enlarged view of a situation during purging in the shuttle type print head 250.

As described above, during purging, the nozzle surface 252 of one head is positioned facing the purge receiving cap section 254 of the other head, and ink droplets 286 are ejected from the nozzles 51 of the nozzle surface 252 onto a porous member 284 formed inside the purge receiving cap section 254.

Since the ink droplets 286 are ejected horizontally in this way, they gradually fall down due to their own weight. Therefore, if nozzles 251 are formed in the lower end of the nozzle surface 252, then the ink droplets ejected from the nozzles formed on this lower end may not reach the purge receiving cap section 254. Considering these circumstances, as shown in FIG. 17, a nozzle-free region 288 where no nozzles are formed is established in the lower end of the nozzle surface 252.

However, as stated below, if the purge receiving cap section 254 is movable in the vertical direction, then it is possible to collect ink droplets 286 ejected from the lower-positioned nozzles 251, by moving the purge receiving cap section 254 downward. Hence, if the purge receiving cap section 254 is vertically movable, then there is no need to provide a nozzle-free region.

Figure 18:
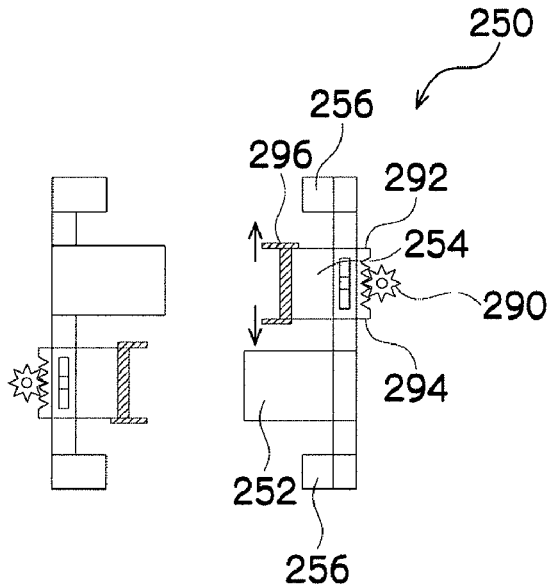
FIG. 18 is an illustrative diagram showing a purge receiving mechanism that can be moved up and down.

FIG. 18 shows an approximate view of a mechanism that is capable of moving the purge receiving cap section 254.

As shown in FIG. 18, in the shuttle type print head 250, spare spaces are provided both above and below the purge receiving cap section 254, in such a manner that the purge receiving cap section 254 can be moved into the spare space. In this case, the purge receiving cap section 254 is moved upward and downward by means of a rack and pinion mechanism including a pinion 290 and a rack 292.

More specifically, by driving the pinion 290 by means of a stepping motor (not illustrated), the purge receiving cap section 254 is moved upward and downward along sliding guides 294, via the rack 292. By making the purge receiving cap section 254 vertically movable in this way, it is unnecessary to form a nozzle-free region.

Also in the case of the line type head in the first embodiment shown in FIG. 10, if the purge receiving cap sections 38*b* are composed so as to be vertically movable, then there is no need to provide the nozzle-free region 194 on the nozzle surfaces 38*a*.

Furthermore, in FIG. 18, the purge receiving cap section 254 may be vertically movable and, for example, a wiper blade 296 made of rubber may be installed at the front end of the cap section. In this case, it is possible to wipe the nozzle surface 252, as the purge receiving cap section 254 is moved up and down.

Next, modification examples of the purge receiving cap section 254 are described below.

Figure 19A:
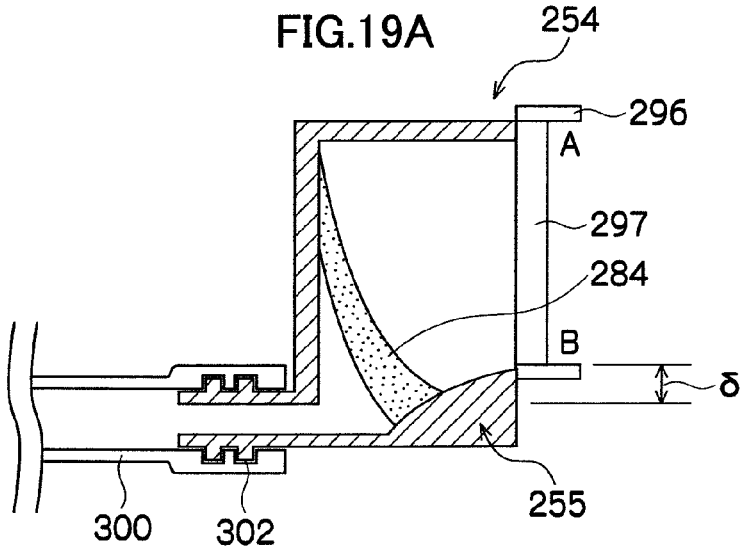
FIGS. 19A to 19C are illustrative diagrams showing various examples of purge receiving.
Figure 19B:
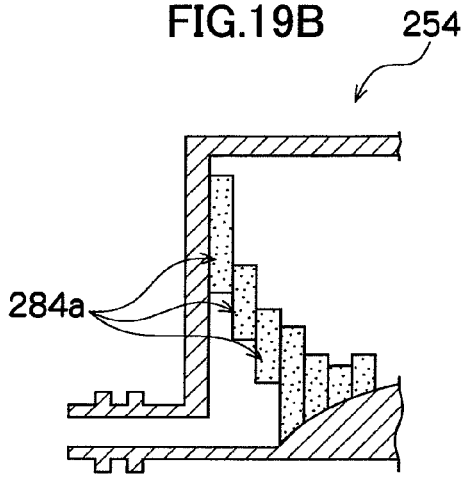
Figure 19C:
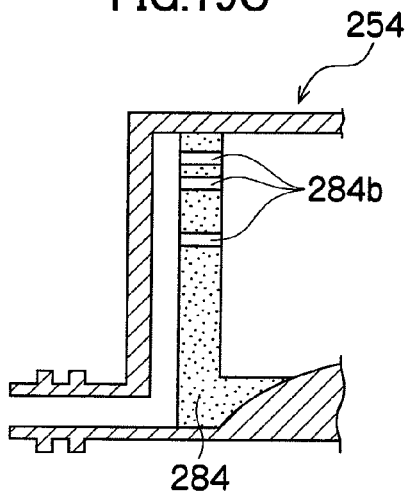

FIGS. 19A to 19C show modification examples of the purge receiving cap section 254 of this kind. Firstly, in the example shown in FIG. 19A, the purge receiving cap section 254 is fixed in position, by an undulated stopping member 302, on a silicon tube 300 which is connected to the ink flow channel 274 (see FIG. 16) that is connected to the ink recovery tank 280.

In order to prevent leaking of the received ink droplets, the rear side of the lower end 255, where the porous member 284 is disposed, is lower than the front side thereof by a distance of δ, thereby the lower end 255 of the purge receiving cap section 254 forming a liquid stored space. Furthermore, a rubber wiper blade 296 is formed on the side facing the nozzle surface 252, and the cap section 297 that caps the nozzle surface 252 is also made of rubber, thereby improving the contact properties and sealing properties when the head is capped and ink is pumped out.

Furthermore, the porous member 284 inside the purge receiving cap section 254 receives and keeps the ink droplets, and prevents liquid leakage caused by the action of the blade (wiping action) during the purge receiving cap section 254 being moved up and down. Furthermore, the shape of the porous member 284 is designed in such a manner that the suctional force acting at the upper point A of the cap section 297 is substantially the same as that acting at the lower point B thereof during suctioning, in order to stabilize the loss in the porous member 284. In the case of a long head, such as that of the above-described first embodiment shown in FIG. 10, it is particularly valuable to form the porous member 182 of the purge receiving cap section 38*b* in a shape of this kind.

Furthermore, it is not necessary to form the porous member 284 in an integral fashion as shown in FIG. 19A, and it is possible to form the porous member 284 by laminating a plurality of plate-shaped porous members 284*a*, as shown in FIG. 19B. In this case, the manufacturing process becomes simpler.

Moreover, as shown in FIG. 19C, it is also possible to open holes 284*b* having a larger diameter than the diameter of the porous holes, on the upper side of the porous member 284, in such a manner that the suctional force on the upper side and lower side of the porous member 284 can be adjusted. By adjusting the suctional force by opening holes 284*b* in this way, there is no need to give the porous member 284 a complicated shape as in FIG. 19A or FIG. 19B, and hence the shape can be simplified and the manufacturing process becomes simpler.

Next, with reference to the flowchart in FIG. 20, a purging operation in a case where the purge receiving cap section 254 can be moved up and down as shown in FIG. 18, is described below.

Figure 20:
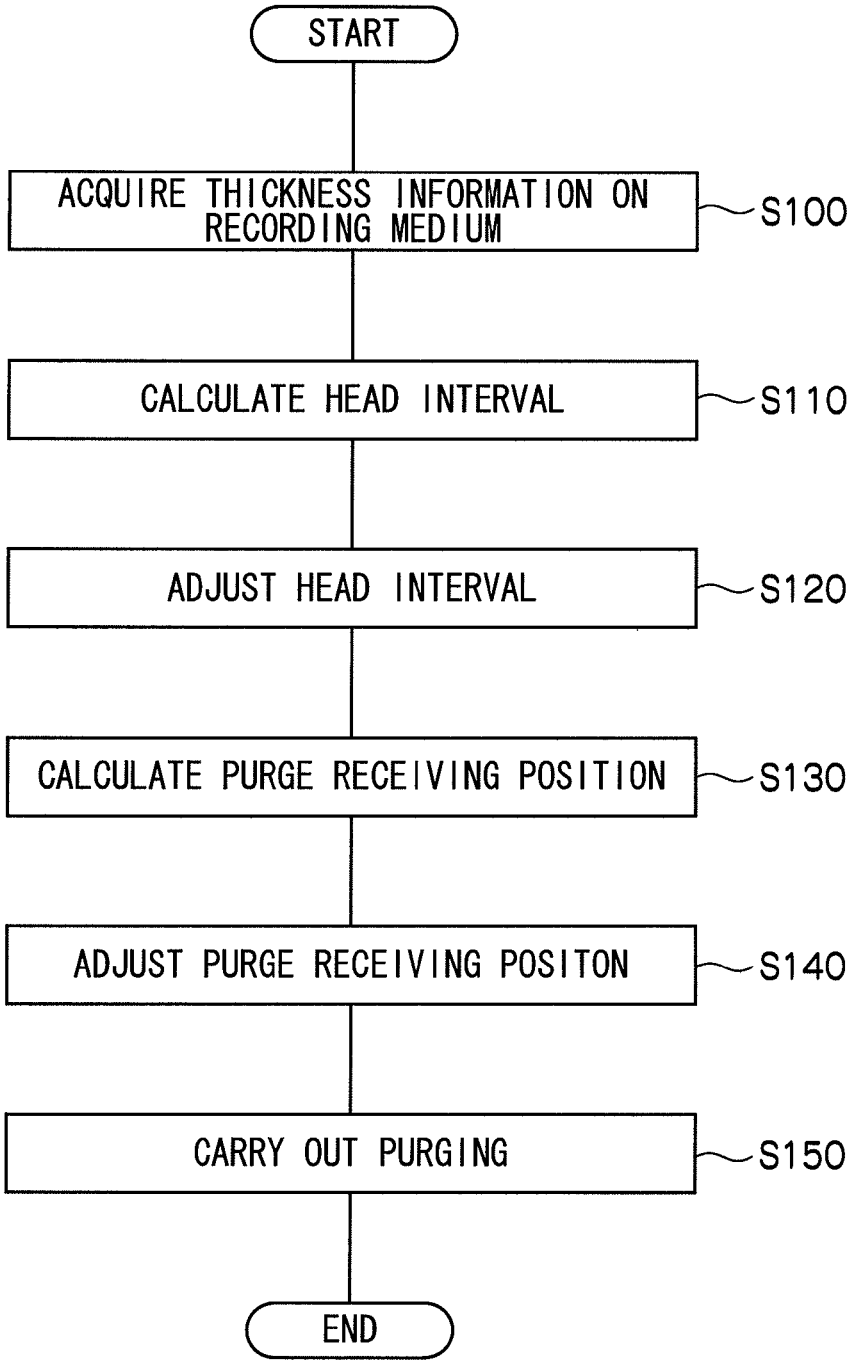
FIG. 20 is a flowchart showing a purging operation by a purge receiving device that can move up and down.

Firstly, in step S100 in FIG. 20, the thickness information of the recording medium 22 is acquired. There are no particular restrictions on the method of acquiring the thickness information. As stated in the first embodiment, it is possible to measure the thickness optically by means of the thickness sensor 80 (see FIG. 6) in the supply unit 12, and it is also possible for the operator to input the thickness information separately.

Next, at step S110, the distance between the opposing shuttle type print heads 250 is calculated on the basis of the thickness information relating to the recording medium 22, which is acquired as described above. Further, the amount of rotation of a stepping motor (shown as the motor 264, in FIG. 15) required to achieve the calculated distance between the heads, is calculated.

Thereupon, at step S120, the motor 264 is driven, and the opposing shuttle type print heads 250 are moved in such a manner that the distance between the heads attains the calculated head-head distance as described above.

Thereupon, at step S 130, the position for the ink-receiving in purging is calculated on the basis of the thickness information on the recording medium 22. This is calculated according to the ink ejection speed, the distance between the head and the cap on the basis of the thickness of the recording medium 22, the weight of the ink droplets, the gravity, and the like. Alternatively, rather than calculating in this way, it is possible to previously record a table which associates the thickness of the recording medium 22 with the positions for the ink-receiving in purging, in such a manner that the position for the ink-receiving in purging can be determined by referring to the table. Moreover, the amount of rotation of the stepping motor that rotates the pinion 290 in order to achieve the position for the ink-receiving in purging (see FIG. 18), is calculated.

The calculation of the positions for the ink-receiving in purging may actually be carried out in parallel with step S110 to S120 described above.

Next, at step S140, the positions of the purge receiving cap sections 254 on either side are adjusted by simultaneously moving the purge receiving cap sections 254 in the vertical direction, in such a manner that the purge receiving cap sections 254 achieve the position for the ink-receiving in purging which is calculated as described above.

When the foregoing preparations have been completed, purging is carried out at step S150.

Furthermore, if there is no recording medium 22 in the vicinity of the head and a head wiping instruction is input, then a (blade) wiping operation is performed as described below. The timings at which a wiping instruction is output are determined, for example, by counting the number of sheets of recording media that have been treated, or by counting the time period since the previous wiping operation.

In performing wiping, firstly, for example, an initial position is set at the position for the ink-receiving in purging determined as indicated in the flowchart in FIG. 20 described above, and the distance between the mutually facing shuttle type print heads 250 is reduced, so that the wiping blades 296 (see FIG. 18) make contact with the opposing nozzle surfaces 252.

Thereupon, by moving the purge receiving cap sections 254 up and down, wiping of the nozzle surfaces 252 is performed by the wiping blades 296.

The foregoing descriptions relate to cases where the print head is a line type head or shuttle type head. Double-side recording can be carried out substantially simultaneously, by holding the recording surfaces of the recording medium substantially vertically and conveying the recording medium in a horizontal direction, print heads being disposed in opposing positions on either side of the conveyed recording medium. Consequently, it is possible to perform double-side recording satisfactorily, even onto a rigid plate-shaped recording medium that is heavy and unbendable.

Furthermore, since the purge receiving cap section is provided in each of the facing print heads, in such a manner that the purge receiving cap section faces the nozzle surface, the purged ink can be gathered reliably, and soiling of the periphery of the nozzle surface is avoided, thus making it possible to improve the quality of the recorded image.

The image recording apparatus and inkjet apparatus for double-side recording according to the present invention have been described above in detail; however, the present invention is not limited to the aforementioned embodiments, and it is of course possible to make various improvements or modifications on the embodiments, within a scope which does not deviate from the essence of the present invention.

It should be understood that there is no intention to limit the invention to the specific forms disclosed, but on the contrary, the invention is to cover all modifications, alternate constructions and equivalents falling within the spirit and scope of the invention as expressed in the appended claims.

What is claimed is:

1. An image recording apparatus, comprising:

a liquid ejection head which is disposed in such a manner that a lengthwise direction thereof is vertically oriented, the liquid ejection head ejecting liquid in a horizontal direction;

common liquid chambers which are divided and extend in a vertical direction, the common liquid chambers supplying the liquid to ejection openings of the liquid ejection head;

sub-tanks which are connected to the common liquid chambers and supply the liquid to the common liquid chambers, negative pressures in the common liquid chambers being adjusted by controlling a difference between top heights of the liquids in the sub-tanks; and a main tank which supplies the liquid to one of the sub-tanks in which the top height of the liquid is controlled so as to be the highest of those in the sub-tanks, through a bottom of the one of the sub-tanks.

2. The image recording apparatus as defined in claim 1, wherein the negative pressures in the common liquid chambers are adjusted by moving the liquid between the sub-tanks in accordance with the difference between the top heights of the liquids in the sub-tanks, in such a manner that each of the top heights of the liquids in the sub-tanks corresponds to a vertical position of the corresponding common liquid chamber.

3. An inkjet apparatus for double-side recording, comprising:

liquid ejection heads which are disposed on either side of a recording medium and face each other across the recording medium in such a manner that a lengthwise direction of the liquid ejection heads is vertically oriented, the liquid ejection heads ejecting liquid in a horizontal direction onto recording surfaces of the recording medium;

common liquid chambers which are divided and extend in a vertical direction, the common liquid chambers supplying the liquid to ejection openings of the liquid ejection head;

sub-tanks which are connected to the common liquid chambers and supply the liquid to the common liquid chambers, negative pressures in the common liquid chambers being adjusted by controlling a difference between top heights of the liquids in the sub-tanks;

conveyance devices which hold the recording medium in such a manner that a normal of each of the recording surfaces is substantially horizontal, and convey the recording medium in a horizontal direction in such a manner that the recording surfaces face ejection surfaces of the liquid ejection heads; and end supporting devices which support an upper end and a lower end of the recording medium, as the conveyance devices convey the recording medium in a horizontal direction while holding the recording medium in such a manner that the normal of each of the recording surfaces is substantially horizontal.

4. The inkjet apparatus as defined in claim 3, further comprising ultraviolet light irradiation devices which are disposed on either side of the recording medium, wherein:

the liquid is an ultraviolet-curable ink; and the ultraviolet light irradiation devices irradiate ultraviolet light onto the recording surfaces after the liquid ejection heads eject liquid onto the recording surfaces.

5. The inkjet apparatus as defined in claim 4, wherein at least one of distance between the liquid ejection heads facing each other across the recording medium, distance between the ultraviolet light irradiation devices facing each other across the recording medium, distance between the conveyance devices facing each other across the recording medium, and distance between the end supporting devices facing each other across the recording medium, is variable.

6. The inkjet apparatus as defined in claim 5, further comprising a thickness measurement device which measures thickness of the recording medium, wherein the at least one of the distance between the liquid ejection heads, the distance between the ultraviolet light irradiation devices, the distance between the conveyance devices, and the distance between the end supporting devices, is changed in accordance with the thickness of the recording medium.

7. The inkjet apparatus as defined in claim 6, wherein:

a plurality of the end supporting devices for fixed different sizes corresponding to various thicknesses of an end of the recording medium, are provided; and the end supporting devices are exchanged in accordance with the thickness of the recording medium.

8. The inkjet apparatus as defined in claim 3, further comprising:

a recording medium supply device which rotates the recording medium, which is chosen from a plurality of recording media which are stacked in a horizontal position, in such a manner that the recording medium is oriented vertically, and sends the recording medium to the conveyance devices; and an output device which receives the recording medium which is held in a vertical position and conveyed after recording, rotates the recording medium in such a manner that the recording medium is oriented horizontally, and stacks the recording medium.

* * * * *